US011199801B2

(12) United States Patent
Isobe

(10) Patent No.: US 11,199,801 B2
(45) Date of Patent: Dec. 14, 2021

(54) SHEET DISCHARGING APPARATUS HAVING ELECTROSTATIC CHARGE REMOVAL AND IMAGE FORMING APPARATUS

(71) Applicant: CANON KABUSHIKI KAISHA, Tokyo (JP)

(72) Inventor: Kenichirou Isobe, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 96 days.

(21) Appl. No.: 16/718,893

(22) Filed: Dec. 18, 2019

(65) Prior Publication Data

US 2020/0209799 A1 Jul. 2, 2020

(30) Foreign Application Priority Data

Dec. 27, 2018 (JP) ..... JP2018-246304

(51) Int. Cl.
*G03G 15/00* (2006.01)
*B65H 29/14* (2006.01)

(52) U.S. Cl.
CPC ..... *G03G 15/6552* (2013.01); *B65H 29/14* (2013.01)

(58) Field of Classification Search
USPC ..... 271/314
See application file for complete search history.

(56) References Cited

U.S. PATENT DOCUMENTS

| | | | | |
|---|---|---|---|---|
| 6,048,119 | A * | 4/2000 | Kato | B65H 29/20 271/208 |
| 2010/0278576 | A1* | 11/2010 | Suzuki | B65H 29/70 399/405 |
| 2017/0107071 | A1* | 4/2017 | Agata | B65H 31/02 |
| 2017/0326890 | A1 | 11/2017 | McCallum | |

FOREIGN PATENT DOCUMENTS

| | | | |
|---|---|---|---|
| JP | 10-157905 | A | 6/1998 |
| JP | 10-302993 | A | 11/1998 |
| JP | 2000038246 | A * | 2/2000 |
| JP | 2004-10240 | A | 1/2004 |
| JP | 2008-120531 | A | 5/2008 |
| JP | 2013-032213 | A | 2/2013 |
| JP | 2019-55849 | A | 4/2019 |

OTHER PUBLICATIONS

Japanese Office Action dated Oct. 13, 2020, in related Japanese Patent Application No. 2018-246304.

* cited by examiner

*Primary Examiner* — Q Grainger
(74) *Attorney, Agent, or Firm* — Venable LLP

(57) ABSTRACT

A sheet discharging apparatus includes a discharging unit to discharge a sheet such that the sheet nipped between a first roller and a second roller is warped as viewed from a downstream side in a sheet discharge direction, a sheet supporting member to support the sheet discharged by the discharging unit, and a first charge-removing portion to remove electrostatic charges of the sheet by coming into contact with the sheet at a position downstream of a position where the first roller and the second roller nip the sheet in the sheet discharge direction. In addition, a second charge-removing portion removes electrostatic charges of the sheet by coming into contact with the sheet at a position downstream of the position where the first charge-removing (Continued)

portion comes into contact with the sheet in the sheet discharge direction.

18 Claims, 18 Drawing Sheets

SHEET DISCHARGING APPARATUS HAVING ELECTROSTATIC CHARGE REMOVAL AND IMAGE FORMING APPARATUS

BACKGROUND OF THE INVENTION

Field of the Invention

The present invention relates to a sheet discharging apparatus that discharges a sheet and an image forming apparatus that forms an image on the sheet.

Description of the Related Art

A sheet discharged from an image forming apparatus such as a printer, a copier, or a multifunctional apparatus is sometimes electrostatically charged by, for example, provided with charges in an image formation process of an electrophotographic system or being charged by friction on a conveyance guide. However, when the sheet is charged, the sheet may be electrostatically attached to the conveyance guide or another sheet on a discharge tray, which may cause conveyance failure or stacking failure of the sheet. Therefore, there is known a sheet discharging apparatus including a charge-removing brush that comes into contact with the sheet discharged by a discharge roller and removes the charges as disclosed in Japanese Patent Laid-Open No. H10-157905.

However, the sheet discharging apparatus including a charge-removing brush as in the document described above has a risk that a leading edge of the sheet is damaged by hitting the charge-removing brush, or the charge-removing brush rubs the surface of the sheet to leave a scratch mark thereon.

SUMMARY OF THE INVENTION

The present invention provides a sheet discharging apparatus and an image forming apparatus capable of reducing the risk of damage of the sheet caused by a charge-removing configuration.

According to one aspect of the invention, a sheet discharging apparatus includes: a discharging unit configured to discharge a sheet in a sheet discharge direction, including a first roller and a second roller, and configured such that the sheet nipped between the first roller and the second roller is warped as viewed from a downstream side in the sheet discharge direction, the first roller including a plurality of first rotary members configured to come into contact with a first surface of the sheet, the second roller including a plurality of second rotary members configured to come into contact with a second surface of the sheet; a sheet supporting member configured to support the sheet discharged by the discharging unit; a first charge-removing portion configured to remove electrostatic charges of the sheet by coming into contact with the sheet at a position downstream of a position where the first roller and the second roller nip the sheet in the sheet discharge direction; and a second charge-removing portion configured to remove electrostatic charges of the sheet by coming into contact with the sheet at a position downstream of the position where the first charge-removing portion comes into contact with the sheet in the sheet discharge direction.

Further features of the present invention will become apparent from the following description of exemplary embodiments with reference to the attached drawings.

DESCRIPTION OF THE EMBODIMENTS

Exemplary embodiments of the present invention will be described below with reference to drawings.

Figure 1:
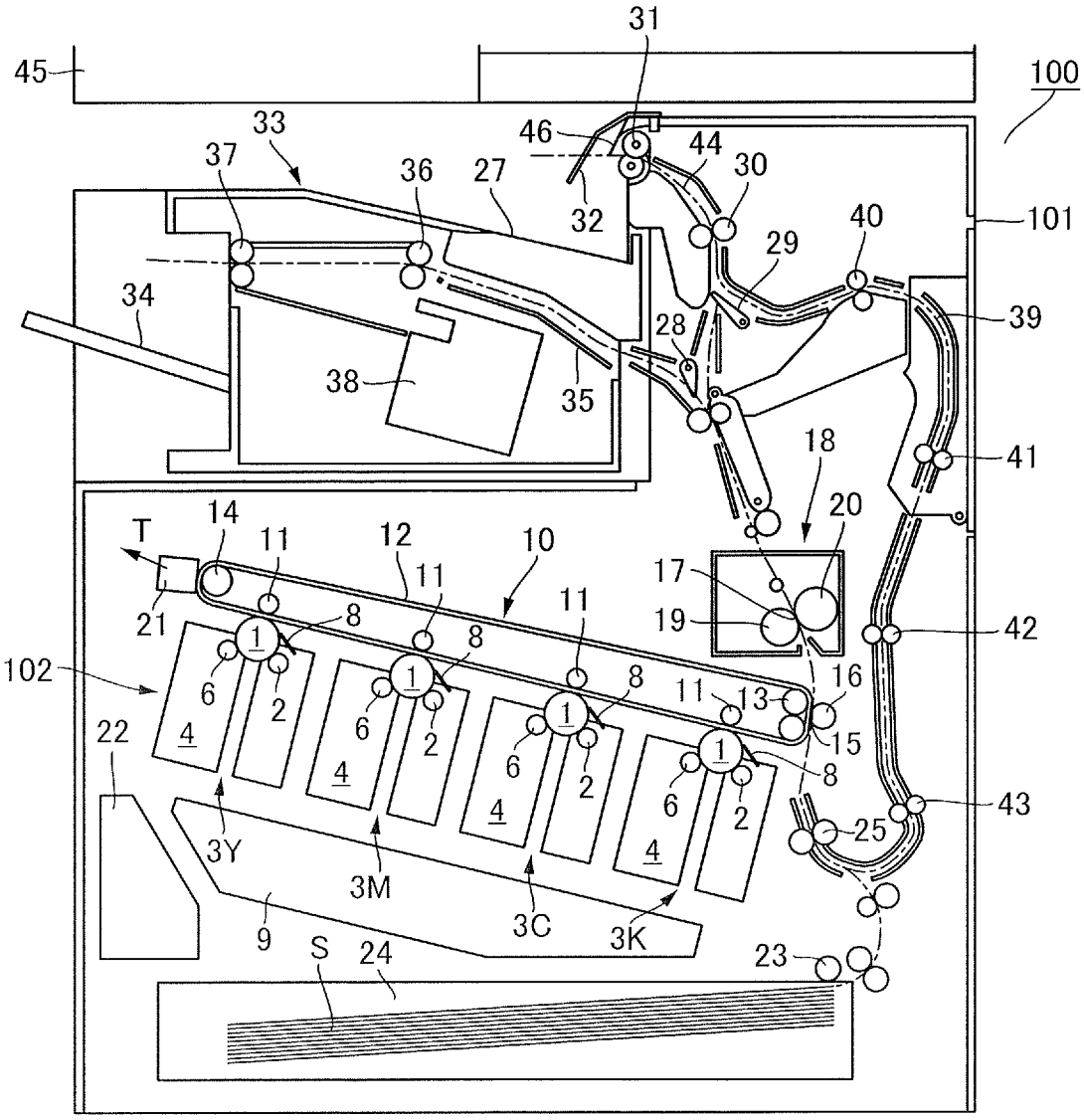
FIG. 1 is a schematic diagram illustrating an image forming apparatus according to exemplary embodiments of the present disclosure.

FIG. 1 is a schematic diagram illustrating an image forming apparatus 100 according to the exemplary embodiments. The image forming apparatus 100 of the exemplary embodiments is a color laser beam printer of an electrophotographic system having a duplex printing function. To be noted, examples of image forming apparatuses to which the exemplary embodiments can be applied are not limited to printers, and include copiers, facsimile machines, and multifunctional apparatuses.

The image forming apparatus 100 includes a printer body 101 incorporating an image forming portion 102 of an electrophotographic system, an image reading apparatus 45 disposed above the printer body 101, and a sheet processing apparatus 33 connected to the printer body 101. The image forming apparatus 100 of the present exemplary embodiment has a so-called in-body discharge configuration in which a sheet discharge space is provided between the image forming portion 102 and the image reading apparatus 45 in the vertical direction, and the sheet processing apparatus 33 is disposed in the sheet discharge space.

The image forming portion 102 includes process cartridges 3Y, 3M, 3C, and 3K attachable to and detachable from a casing of the printer body 101. The four process cartridges 3Y to 3K all have the same configuration, and perform an electrophotographic process to respectively form toner images of yellow, magenta, cyan, and black. Y, M, C, and K respectively correspond to yellow, magenta, cyan, and black. That is, when an instruction of image formation is issued to the image forming portion 102, in each of the process cartridges 3Y to 3K, the surface of a photosensitive drum 1 serving as a photosensitive member is uniformly charged by a charging roller 2. Then, an electrostatic latent image corresponding to image information with which image formation is to be performed is drawn on the surface of the photosensitive drum 1 by laser light emitted from a laser scanner 9. This electrostatic latent image is visualized, that is, developed into a toner image with charged toner particles supplied to the photosensitive drum 1 from a developing roller 6 of a developing unit 4.

The toner image born on the photosensitive drum 1 is transferred onto an intermediate transfer belt 12 through primary transfer by a primary transfer roller 11. On this occasion, toner images of single colors respectively formed in the process cartridges 3Y to 3K are transferred so as to be superimposed on one another on the intermediate transfer belt 12, and thus a full-color toner image is formed on the intermediate transfer belt 12. Attached matter such as transfer residual toner remaining on the surface of the photosensitive drum 1 without being transferred onto the intermediate transfer belt 12 is removed by a drum cleaner 8, and is collected into a collection container 22.

In an intermediate transfer belt unit 10, the intermediate transfer belt 12 serving as an intermediate transfer member is stretched over a driving roller 13 and a tension roller 14. The tension roller 14 is urged in an arrow T direction in FIG. 1, and imparts an appropriate tension to the intermediate transfer belt 12. The driving roller 13 rotates the intermediate transfer belt 12 in a direction along the rotation direction of the photosensitive drums 1 of the process cartridges 3Y to 3K, that is, in a counterclockwise direction in FIG. 1.

The driving roller 13 also serves as a secondary transfer inner roller, and a secondary transfer roller 16 is disposed at a position opposing the driving roller 13 with the intermediate transfer belt 12 therebetween. The toner image born on the intermediate transfer belt 12 is transferred from the intermediate transfer belt 12 onto a sheet S serving as a recording material in a secondary transfer portion 15 that is a nip portion between the intermediate transfer belt 12 and the secondary transfer roller 16. Attached matter such as transfer residual toner remaining on the intermediate transfer belt 12 without being transferred onto the sheet S is removed by a belt cleaner 21 and collected into the collection container 22.

The sheet S onto which the toner image has been transferred in the secondary transfer portion 15 is conveyed to a fixing unit 18. The fixing unit 18 includes a fixing roller 19, a pressurizing roller 20 in pressure contact with the fixing roller 19, and a heat source such as a halogen lamp that heats the toner image on the sheet S via the fixing roller 19. When the sheet S passes through a fixing nip 17 between the fixing roller 19 and the pressurizing roller 20, heat and pressure are applied to the toner image to melt the toner. Then, the toner adheres to the sheet S, and thus an image fixed onto the sheet S is obtained.

In parallel with the image formation process described above, sheets S are fed one by one from a feeding cassette 24 provided in a lower portion of the printer body 101. The sheets S accommodated in the cassette 24 are fed out by a feeding roller 23 and conveyed to a registration roller 25 in a state of being separated from each other by a friction-separation roller pair or the like. The registration roller 25 stops the leading edge of the sheet S to correct the skew of the sheet S, and then delivers the sheet S to the secondary transfer portion 15 at a timing synchronized with the image formation process performed by the image forming portion 102.

The sheet S on which an image has been formed by passing through the secondary transfer portion 15 and the fixing nip 17 is conveyed along a conveyance path guided by guide members 28 and 29. In the case of discharging the sheet S to the sheet processing apparatus 33, the sheet S is guided to a conveyance path 35 inside the sheet processing apparatus 33 by the guide member 28, and is discharged onto a discharge tray 34 provided on a side surface of the sheet processing apparatus 33 by a conveyance roller 36 and a discharge roller 37. In the case of performing a process such as a binding process, sheets S are stacked on an intermediate tray by the conveyance roller 36, and are discharged by the discharge roller 37 after the process is performed by a processing unit 38.

In the case of discharging the sheet S onto a discharge tray 27 provided on an upper surface of the sheet processing apparatus 33, the sheet S is guided to a discharge path 44 by the guide member 28. A conveyance roller 30 disposed in the discharge path 44 conveys the sheet S toward a discharge roller pair 31, and the discharge roller pair 31 discharges the sheet S to the outside of the printer body 101 to be supported on the discharge tray 27. A full load detection flag 32 for detecting the height of a sheet stack on the discharge tray 27 exceeding a predetermined value is provided above the discharge tray 27, and the sheet S is discharged while pushing up the full load detection flag 32. In addition, a charge-removing brush 46 that will be described later is disposed in the vicinity of the discharge roller pair 31, and removes charges on the surface of the sheet S by coming into contact with the sheet S discharged by the discharge roller pair 31.

To be noted, although a configuration in which the discharge tray 27 serving as an example of a sheet supporting member is provided on the upper surface of the sheet processing apparatus 33 has been described herein, a configuration in which the discharge roller pair 31 discharges the sheet S onto a discharge tray provided in the printer body 101 may be employed.

In the case of performing duplex printing, the sheet S on a first surface of which an image has been formed is guided to the discharge path 44 by the guide member 28, and then switched back by the discharge roller pair 31. That is, after the discharge roller pair 31 conveys the sheet S toward the discharge tray 27 and a trailing edge of the sheet S passes by the guide member 29, the discharge roller pair 31 starts rotating in a reverse direction at a timing before the trailing edge of the sheet S passes through the discharge roller pair 31. The sheet S is guided to a duplex path 39 by the guide member 29, and is conveyed to the registration roller 25 again by duplex conveyance rollers 40, 41, 42, and 43. Then, the sheet S passes through the secondary transfer portion 15 and the fixing nip 17, thus an image is formed on a second surface of the sheet S, and then the sheet S is discharged onto either one of the discharge trays 27 or 34.

The image reading apparatus 45 includes a reading portion including a document stage, a reading mechanism, and so forth, and a document feeding portion that can be opened and closed with respect to the reading portion. The reading mechanism includes a light source that radiates light onto a document, an image pickup element such as a complementary metal oxide semiconductor: CMOS or a charge-coupled device: CCD, and a lens and a mirror constituting an optical system that guides light reflected on the document to the image pickup element, and an optical image formed on the image pickup element is photoelectrically converted into electronic image information. The document feeding portion feeds documents one by one to a position where an image is read by the reading mechanism. The image reading apparatus 45 is capable of reading image information from both of a still document placed on the document stage and a moving document conveyed by the document feeding portion, and transmits the read image information to a controller of the printer body 101.

To be noted, the image forming portion 102 described above is an example of an image forming portion that forms an image on a sheet, and may be replaced by an electrophotographic unit of a direct transfer system that directly transfers a toner image formed on a photosensitive drum serving as an image bearing member onto a sheet. Further, for example, a printing mechanism of an inkjet system or an offset printing system may be used as the image forming portion.

First Exemplary Embodiment

Figure 2A:
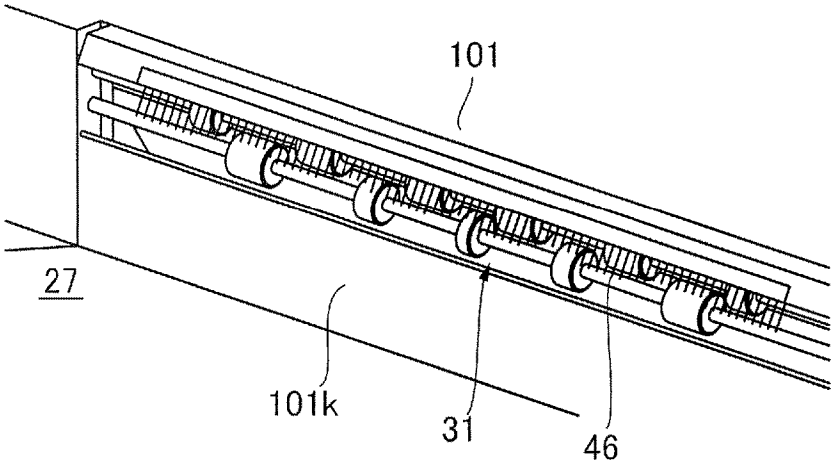
FIG. 2A is a perspective view of a sheet discharge portion of a first exemplary embodiment.
Figure 2C:
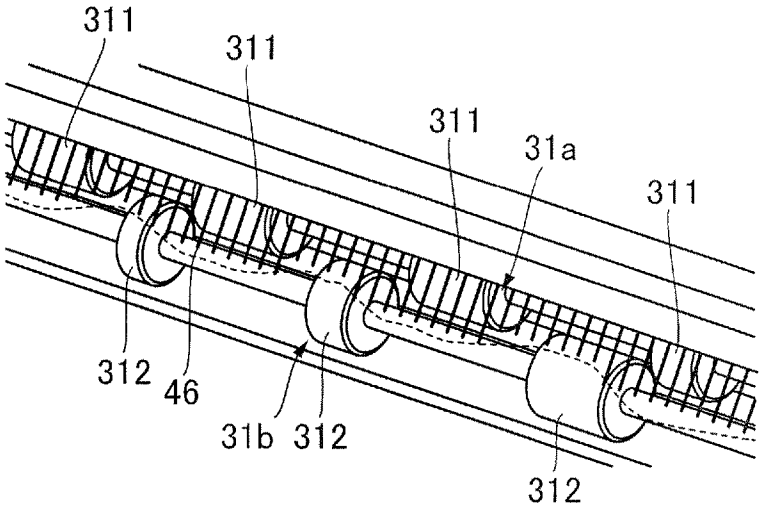
FIG. 2C is an enlarged view of the sheet discharge portion of the first exemplary embodiment.
Figure 2B:
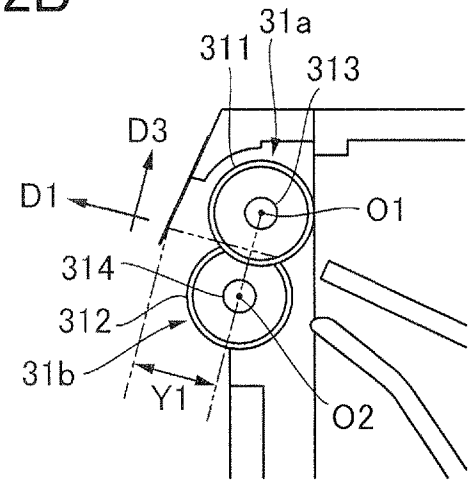
FIG. 2B is a section view of the sheet discharge portion of the first exemplary embodiment.

A configuration of a sheet discharge portion according to a first exemplary embodiment will be described with reference to FIGS. 2A to 2C. FIG. 2A is a perspective view of the sheet discharge portion as viewed from the upper side of the discharge tray 27, FIG. 2B is a section view of the sheet discharge portion as viewed in the axial direction of the sheet discharge roller pair 31, and FIG. 2C is an enlarged view of a part of FIG. 2A.

The discharge roller pair 31 serving as a discharging unit of the present exemplary embodiment is disposed in an opening portion provided in a wall surface 101*k* of the printer body 101 opposing the discharge tray 27 as illustrated in FIG. 2A. The discharge roller pair 31 includes an upper roller 31*a* that comes into contact with an upper surface of a sheet to be discharged, and a lower roller 31*b* that comes into contact with a lower surface of the sheet to be discharged as illustrated in FIG. 2B. The upper roller 31*a* is constituted by a roller shaft 313 and a plurality of rolling members 311 attached to the roller shaft 313, and the lower roller 31*b* is constituted by a roller shaft 314 and a plurality of rolling members 312 attached to the roller shaft 314 as illustrated in FIG. 2C. The rolling members 311 serve as a plurality of first rotary members provided in the upper roller 31*a* serving as a first roller in the present exemplary embodiment, and the rolling members 312 serve as a plurality of second rotary members provided in the lower roller 31*b* serving as a second roller in the present exemplary embodiment.

In the description below, a direction in which the discharge roller pair 31 delivers out a sheet will be referred to as a sheet discharge direction D1, a width direction of the sheet perpendicular to the sheet discharge direction D1 will be referred to as a sheet width direction D2, and a direction perpendicular to the sheet discharge direction D1 and the sheet width direction D2 will be referred to as a sheet thickness direction D3. When viewed in the sheet width direction D2, the thickness direction D3 is a direction of a straight line connecting rotation axes O1 and O2 of the upper roller 31*a* and the lower roller 31*b*, and the sheet discharge direction D1 is perpendicular to this straight line.

Figure 3A:
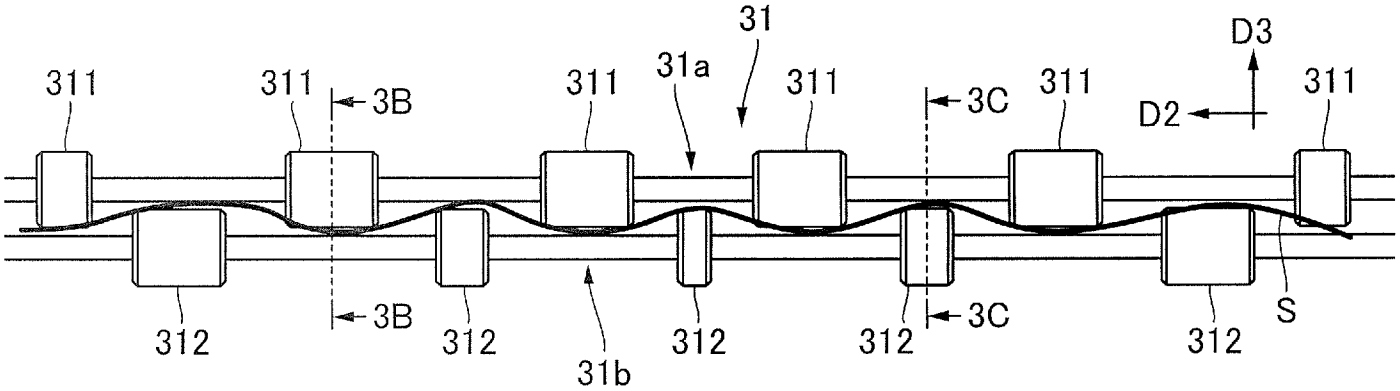
FIG. 3A is a side view of a discharge roller pair of the first exemplary embodiment.
Figure 3B:
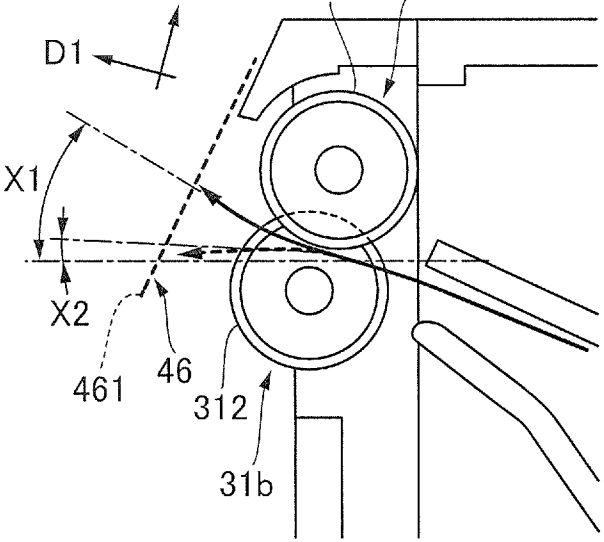
FIG. 3B is a diagram for describing variations of a discharge angle of a sheet.
Figure 3C:
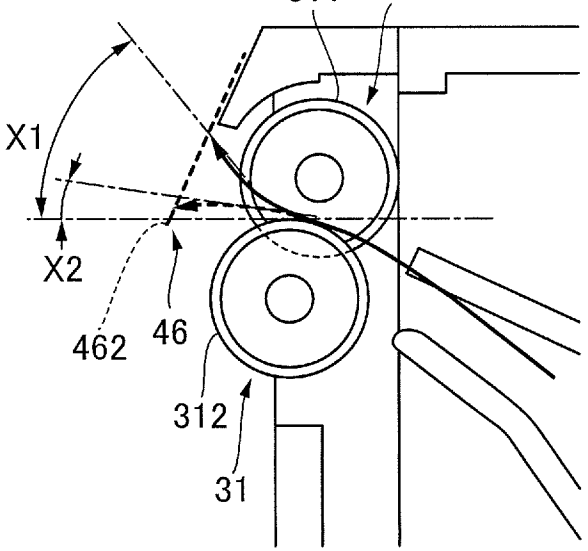
FIG. 3C is another diagram for describing variations of a discharge angle of the sheet.

As illustrated in FIG. 3A, a so-called comb teeth roller pair configuration in which the sheet is nipped in a warped state between the rolling members 311 of the upper roller 31*a* and the rolling members 312 of the lower roller 31*b* is employed for the discharge roller pair 31 of the present exemplary embodiment. In other words, the plurality of rolling members 311 and 312 are arranged at different positions in the axial direction of the discharge roller pair 31, that is, the sheet width direction D2, so as to partially overlap with each other as viewed in the axial direction as illustrated in FIGS. 3B and 3C. Therefore, the sheet S nipped between the discharge roller pair 31 is in a warped state like a wave as viewed in the sheet discharge direction D1, and the flexural stiffness of the sheet against a load in such a direction that the leading edge (i.e., a downstream end in the sheet discharge direction D1) is caused to face downward increases. Center positions of the rolling members 311 and 312 in the sheet width direction D2 correspond to vertices of the wavy shape of the sheet S.

As illustrated in FIGS. 2A to 2C, the charge-removing brush 46 serving as a charge-removing member in the present exemplary embodiment is disposed downstream of the discharge roller pair 31 in the sheet discharge direction D1. The charge-removing brush 46 is a brush-shaped member formed from a flexible material having electrical conductivity. The charge-removing brush 46 can be, for example, a brush formed by fixing first ends of thin metal wires or resin fiber containing carbon fiber to the printer body 101 in a state in which the first ends are bundled by a conductive tape. In addition, the charge-removing brush 46 serves as an example of a charge-removing member, and for example, a sheet material which is obtained by cutting a conductive resin film and whose end portion, that is, a base portion is bonded to an attachment portion provided in the printer body 101 may be used. The charge-removing brush 46 is disposed on the same side as the upper roller 31*a* in the sheet thickness direction D3, and a second end of the charge-removing brush 46 extends downward in a state in which a first end thereof is fixed to the printer body 101. Further, the charge-removing brush 46 is connected to the ground potential via a metal frame of the printer body 101 or the like.

The charge-removing brush 46 of the present exemplary embodiment is formed so as to have different lengths at different positions in the sheet width direction D2 in accordance with the wavy shape of the sheet S formed by the discharge roller pair 31 as illustrated in FIG. 2C. That is, distal ends 461 of the charge-removing brush 46 in positions corresponding to the rolling members 311 of the upper roller 31*a* illustrated in FIG. 3B are at a first height in the thickness direction D3. In contrast, distal ends 462 of the charge-removing brush 46 in positions corresponding to the rolling members 312 of the lower roller 31*b* illustrated in FIG. 3C are at a second height higher than the first height in the thickness direction D3.

In other words, the distal ends 462 of the brush in positions corresponding to "mountains" of the wavy shape of the sheet are offset in a direction in which a projection amount of the brush with respect to the sheet becomes smaller, which is upward in the present exemplary embodiment, than that of the distal ends 461 of the brush in positions corresponding to "valleys" of the wavy shape. The projection amount of the charge-removing brush 46 with respect to the sheet refers to the length of projection of the distal ends of the brush in the thickness direction D3 with respect to an average position of passage of the sheet discharged by the discharge roller pair 31, at respective positions in the sheet width direction D2.

In the present exemplary embodiment, the projection amount of the charge-removing brush 46 with respect to the sheet in a region in the sheet width direction D2 where the rolling members 311 of the upper roller 31*a* are provided is a distance in the thickness direction D3 between a lower end position of the rolling members 311 in the thickness direction D3 and the distal ends 461 of the brush. Similarly, the projection amount of the charge-removing brush 46 with respect to the sheet in a region in the sheet width direction D2 where the rolling members 312 of the lower roller 31*b* are provided is a distance in the thickness direction D3 between an upper end position of the rolling members 312 in the thickness direction D3 and the distal ends 462 of the brush. The offset amounts of the distal ends 461 and 462 of the brush corresponding to the wavy shape of the sheet are preferably set such that, for example, the projection amount of the charge-removing brush 46 with respect to the sheet is constant in the sheet width direction D2.

According to such a configuration, in the case where the sheet S is discharged in a warped state due to the discharge roller pair 31 of a comb-teeth shape, the contact pressure between the charge-removing brush 46 and the sheet S is equalized in the sheet width direction D2. Therefore, while securing charge removing performance by bringing the charge-removing brush 46 into contact with the sheet S in the entire region in the sheet width direction D2, a situation in which the charge-removing brush 46 causes a drag to interrupt discharge of the sheet S can be avoided.

To be noted, the drag that the charge-removing brush 46 applies to the sheet is affected by factors other than the stiffness of the sheet, for example, whether or not the surface of the sheet is treated, the size of the sheet, particularly the length of the sheet in the sheet width direction D2, and environmental factors, particularly the humidity. The configuration of the present exemplary embodiment enables the charge-removing brush 46 to come into contact with the sheet at an equal contact pressure in the sheet width direction D2 in a stable contact state even in the case where these factors change. That is, the configuration of the present exemplary embodiment enables smooth discharge of the sheet while securing charge removing performance of the charge-removing brush 46 for various sheets and environments.

Incidentally, the direction in which the leading edge of the sheet S is delivered out by the discharge roller pair 31 having a comb-teeth shape changes depending on the position in the sheet width direction D2 and the material of the sheet. That is, as illustrated in FIGS. 3B and 3C, the leading edge of a sheet having high stiffness such as a cardboard has a strong tendency of moving along the sheet discharge direction D1 even after being delivered out from the discharge roller pair 31 as indicated by a solid arrow. In contrast, the leading edge of a sheet having low stiffness such as a thin paper sheet has a tendency of, due to its own weight, deviating from the sheet discharge direction D1 right after passing through the discharge roller pair 31 as indicated by a broken arrow. In addition, in the case where the stiffness of the sheet is the same, whereas the leading edge of the sheet is biased toward moving downward by being pushed down by the rolling members 311 in a portion that comes into contact with the upper roller 31*a* illustrated in FIG. 2B in the sheet width direction D2, the leading edge of the sheet is biased toward moving upward by being pushed up by the rolling members 312 in a portion that comes into contact with the lower roller 31*b* illustrated in FIG. 2C.

Therefore, a discharge angle X1 of the leading edge of the sheet having high stiffness in a region in the sheet width direction D2 where the sheet comes into contact with the lower roller 31*b* may be greatly different from a discharge angle X2 of the leading edge of a sheet having low stiffness in a region where the sheet comes into contact with the upper roller 31*a*. In addition, since the influence of downward warpage caused by the weight of the sheet and curling of the sheet itself increase as the leading edge moves farther away from the discharge roller pair 31, the difference in the discharge angle increases as the leading edge moves farther away from the discharge roller pair 31.

Figure 4:
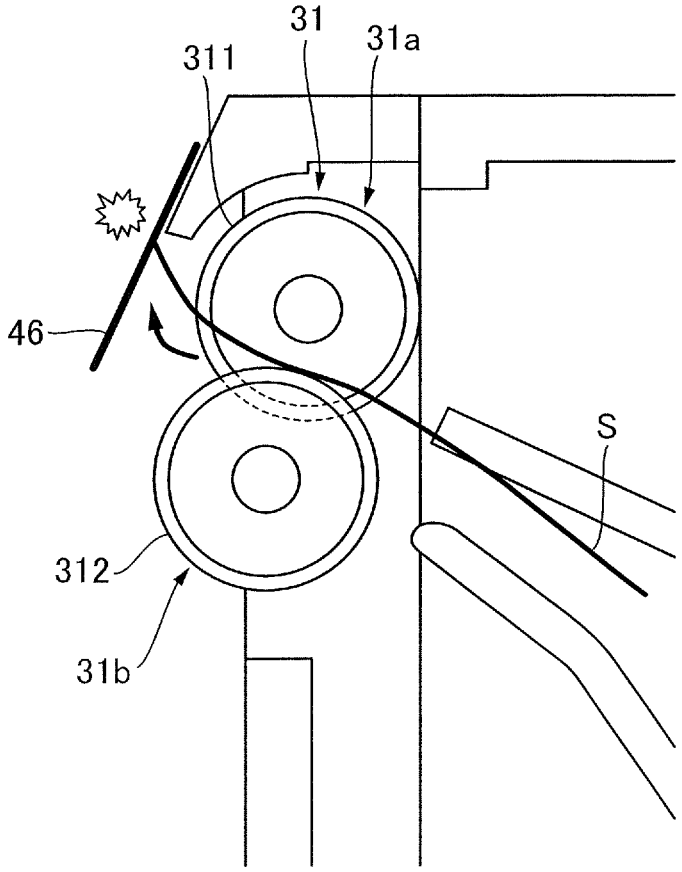
FIG. 4 is a diagram for describing contact between a leading edge of the sheet and a charge-removing brush in the first exemplary embodiment.

Here, in the first exemplary embodiment, the entirety of the charge-removing brush 46 in the sheet width direction D2 is provided at the same position in the sheet discharge direction D1 downstream of the discharge roller pair 31 with a certain distance therebetween due to necessity of avoiding interference with the discharge roller pair 31 or the like. In this configuration, there is a risk that the leading edge of the sheet collides with the charge-removing brush 46 to be damaged, due to the variation in the discharge angle of the sheet. That is, there is a risk that the leading edge of the sheet is damaged when the leading edge of a sheet having high stiffness is delivered out from the discharge roller pair 31 while being pushed up by the rolling members 312 of the lower roller 31*b* and collides with the charge-removing brush 46 at an angle close to 90° as illustrated in FIG. 4.

Figure 5:
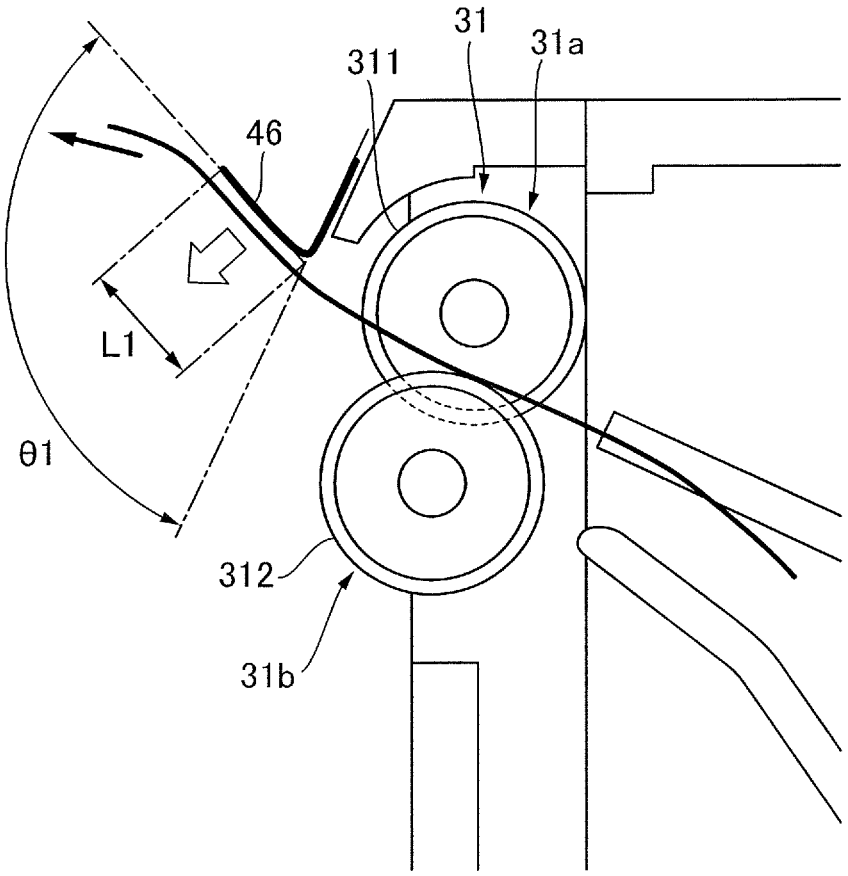
FIG. 5 is a diagram for describing contact between a sheet surface and the charge-removing brush in the first exemplary embodiment.

In addition, in order to stably remove the electrostatic charge of the sheet regardless of the material of the sheet, the length of the charge-removing brush 46 is set on the basis of the discharge angle X2 of the sheet having low stiffness illustrated in FIGS. 3B and 3C. Therefore, as illustrated in FIG. 5, in the configuration of the first exemplary embodiment, an angle θ1 by which the charge-removing brush 46 is warped by being pressed by the sheet having high stiffness and a length L1 of a region where the charge-removing brush 46 rubs the sheet increase, and there is a risk that friction of the charge-removing brush 46 on the sheet leaves a scratch mark on the surface of the sheet.

To address such a risk, optimizing the material, length, and the like of the charge-removing brush 46 can be considered. For example, using a material having high flexibility and high slidability on the sheet for the charge-removing brush 46 can be considered. However, attention needs to be paid to a risk that the cost increases due to fewer options of the material, the charge-removing brush 46 is caught in the discharge roller pair 31 due to higher flexibility, and the like.

Second Exemplary Embodiment

Therefore, in a second exemplary embodiment, the risk of damage to the sheet is reduced by disposing a plurality of charge-removing members at different positions in the sheet discharge direction. Hereinafter, elements having the same configuration and same effect as in the first exemplary embodiment will be denoted by the same reference signs as in the first exemplary embodiment, and the description thereof will be omitted.

Figure 6A:
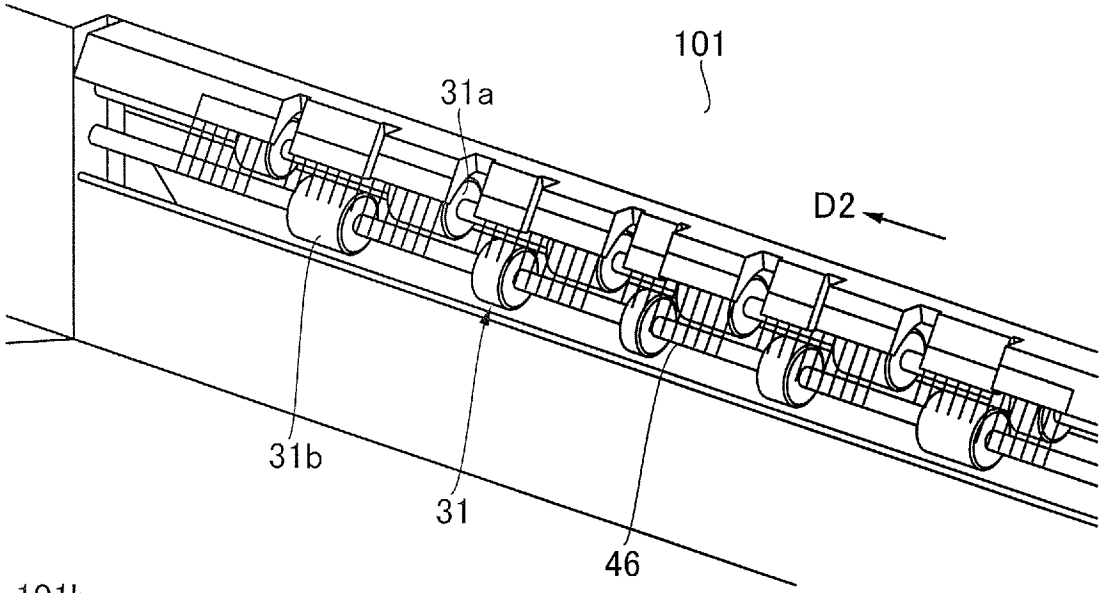
FIG. 6A is a perspective view of a sheet discharge portion of a second exemplary embodiment.
Figure 6C:
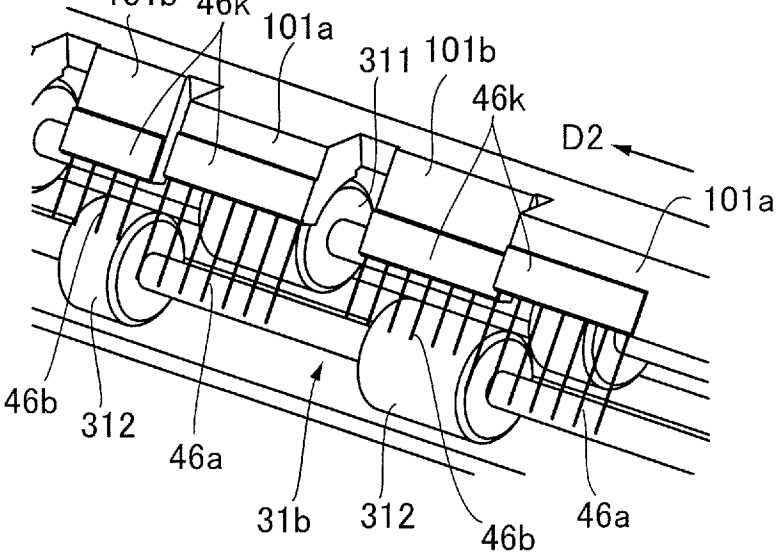
FIG. 6C is an enlarged view of the sheet discharge portion of the second exemplary embodiment.
Figure 6B:
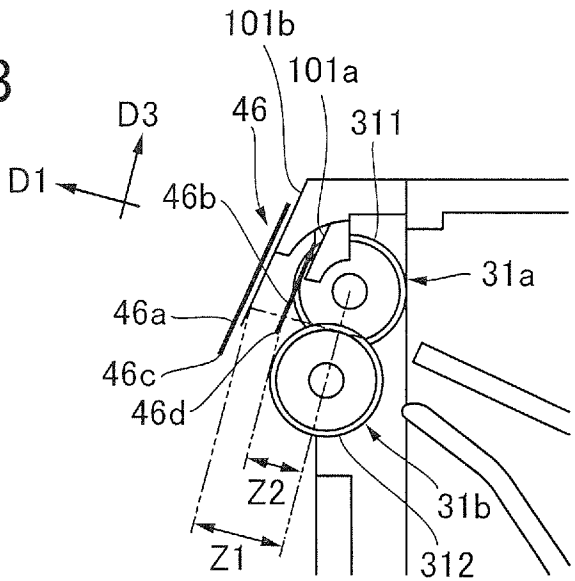
FIG. 6B is a section view of the sheet discharge portion of the second exemplary embodiment.

FIG. 6A is a perspective view of a sheet discharge portion of the present exemplary embodiment, FIG. 6B is a section view of the sheet discharge portion as viewed in the sheet width direction, and FIG. 6C is an enlarged view of a part of FIG. 6A. The discharge roller pair 31 serving as an example of a discharging unit is a comb teeth-shaped roller pair similarly to the first exemplary embodiment.

The charge-removing brush 46 of the present exemplary embodiment can be divided into a downstream brush 46*a* and an upstream brush 46*b* by regions in the sheet width direction D2. The upstream brush 46*b* serves as a first charge-removing portion, that is, a first portion of a charge-removing member in the present exemplary embodiment, and the downstream brush 46*a* serves as a second charge-removing portion, that is, a second portion of the charge-removing member in the present exemplary embodiment.

The downstream brush 46*a* is provided in a region corresponding to the rolling members 311 of the upper roller 31*a* in the sheet width direction D2, that is, in such a region that the downstream brush 46*a* at least partially overlaps with outer peripheral surfaces of the rolling members 311 where the rolling members 311 abut the sheet. In addition, the upstream brush 46*b* is provided in a region corresponding to the rolling members 312 of the lower roller 31*b* in the sheet width direction D2. The downstream brush 46*a* and the upstream brush 46*b* are alternately arranged in the sheet width direction D2. In other words, the first charge-removing portion is constituted by a plurality of portions respectively disposed in a plurality of first regions separated from each other in the sheet width direction, and the second charge-removing portion is constituted by a plurality of second portions respectively disposed in a plurality of second regions separated from each other in the sheet width direction. Particularly, in the present exemplary embodiment, the number of regions where the upstream brush 46*b* is disposed is equal to the number of the rolling members 311, and the number of regions where the downstream brush 46*a* is disposed is equal to the number of the rolling members 312. In addition, the width of each region of the upstream brush 46*b* and the downstream brush 46*a* is approximately equal to the width of the outer peripheral surface of the corresponding one of the rolling members 311 and 312.

As illustrated in FIG. 6B, the upstream brush 46*b* is disposed to come into contact with the sheet at a position upstream of the downstream brush 46*a* in the sheet discharge direction D1. Specifically, the upstream brush 46*b* is disposed at such a position that the upstream brush 46*b* partially overlaps with outer peripheral surfaces of the rolling members 311 of the upper roller 31*a* as viewed in the sheet width direction D2. That is, the upstream brush 46*b* is disposed such that a position where the leading edge of the sheet delivered out from the discharge roller pair 31 first comes into contact with the upstream brush 46*b* is the same as or upstream of a downstream end position of the rolling members 311 in the sheet discharge direction D1.

In contrast, the downstream brush 46*a* is disposed at a position downstream of and separated from the rolling members 311 of the upper roller 31*a* in the sheet discharge direction D1 as viewed in the sheet width direction D2. Therefore, in a state in which the charge-removing brush 46 is not in contact with the sheet, a length Z1 of a line segment drawn from a nip position of the discharge roller pair 31 to the downstream brush 46*a* in the sheet discharge direction D1 is larger than a length Z2 of a line segment drawn from the nip position to the upstream brush 46*b*. To be noted, as illustrated in FIGS. 6B and 6C, an attachment surface 101*b* of the printer body 101 serving as a first attachment surface to which a base portion 46*k* of the upstream brush 46*b* is attached is positioned upstream of an attachment surface 101*a* of the printer body 101 serving as a second attachment surface to which the base portion 46*k* of the downstream brush 46*a* is attached, in the sheet discharge direction D1.

Figure 7:
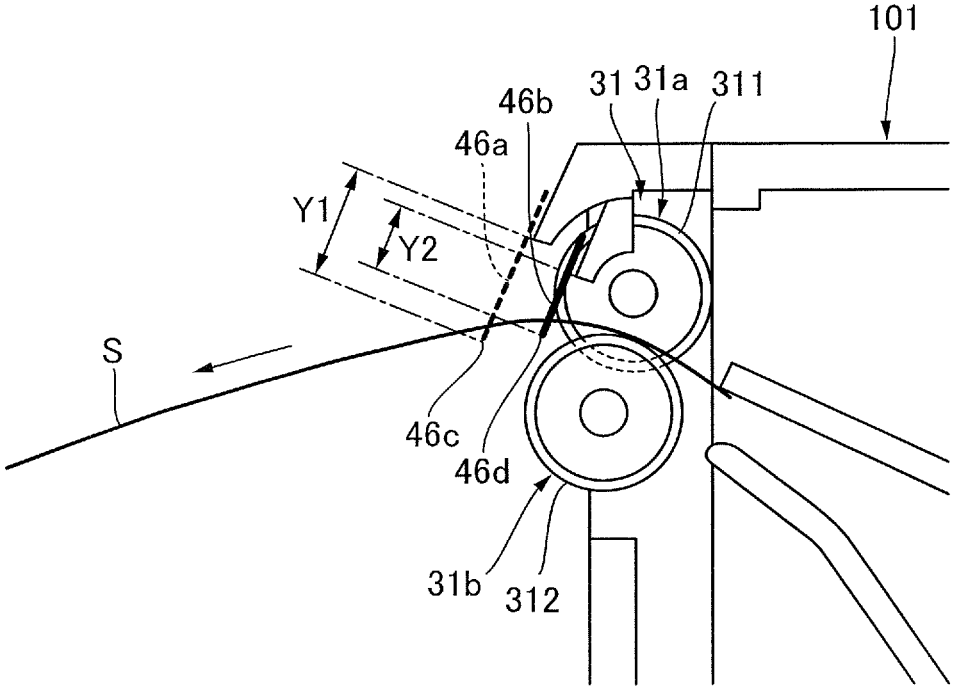
FIG. 7 is a schematic diagram illustrating the surroundings of a charge-removing brush of the second exemplary embodiment.

Further, as illustrated in FIG. 7, a length Y2 of the upstream brush 46*b* is set to be smaller than a length Y1 of the downstream brush 46*a*. In other words, distal ends 46*d* of the upstream brush 46*b* are offset in a direction in which the projection amount with respect to the sheet becomes smaller than that of distal ends 46*c* of the downstream brush 46*a*, which is upward in FIG. 7. Since the upstream brush 46*b* is closer to the nip position of the discharge roller pair 31, the amount of variation of the sheet position in the thickness direction D3 can be estimated to be smaller at the position of the upstream brush 46*b*. That is, the sheet passes through approximately the same position in the thickness direction D3 at the position of the upstream brush 46*b* even in the case where, for example, the sheet being discharged warps downward as the sheet moves away from the discharge roller pair 31 or the leading edge of the sheet is curled upward due to low stiffness of the sheet or the like. Therefore, as compared with the configuration of the first exemplary embodiment in which the entirety of the charge-removing brush is downstream of and separated from the discharge roller pair 31, the charge-removing brush stably comes into contact with the sheet even in the case where the length of the charge-removing brush in the regions in the sheet width direction D2 where the rolling members 312 of the lower roller 31*b* are provided is set to be short.

Figure 8:
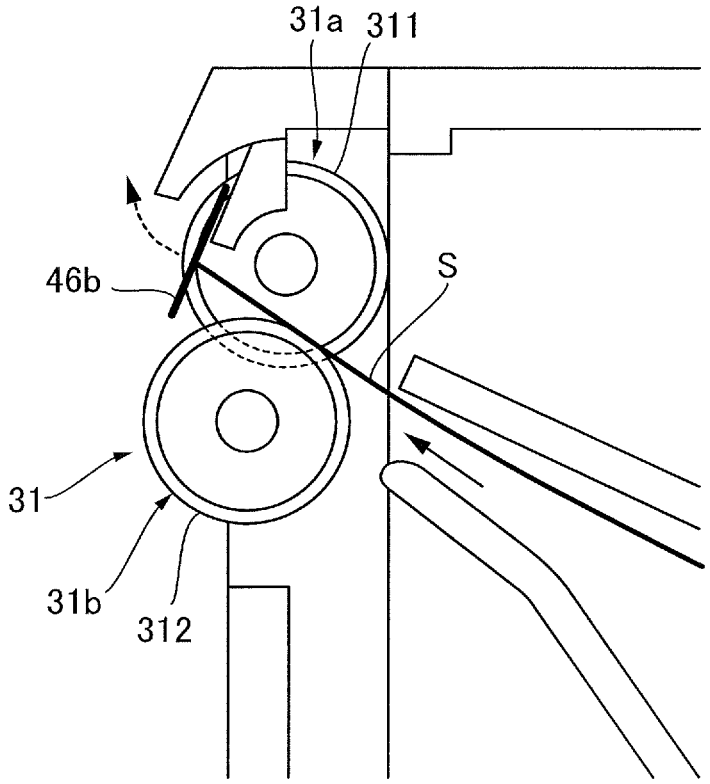
FIG. 8 is a diagram for describing contact between a leading edge of the sheet and an upstream brush in the second exemplary embodiment.

According to the configuration of the present exemplary embodiment, the upstream brush 46*b* of the charge-removing brush 46 comes into contact with the sheet delivered out from the discharge roller pair 31 at a position close to the discharge roller pair 31. In other words, the leading edge of the sheet comes into contact with the upstream brush 46*b* before the discharge angle of the leading edge of the sheet is greatly deviated upward from the designed sheet discharge direction D1 in the regions where the rolling members 312 of the lower roller 31*b* are provided. Therefore, as illustrated in FIG. 8, even in the case where the sheet S having high stiffness is discharged while being pushed up by the rolling members 312 of the lower roller 31*b*, the leading edge of the sheet abuts the upstream brush 46*b* at approximately the same angle, and therefore the leading edge of the sheet is less likely to be damaged.

Figure 9:
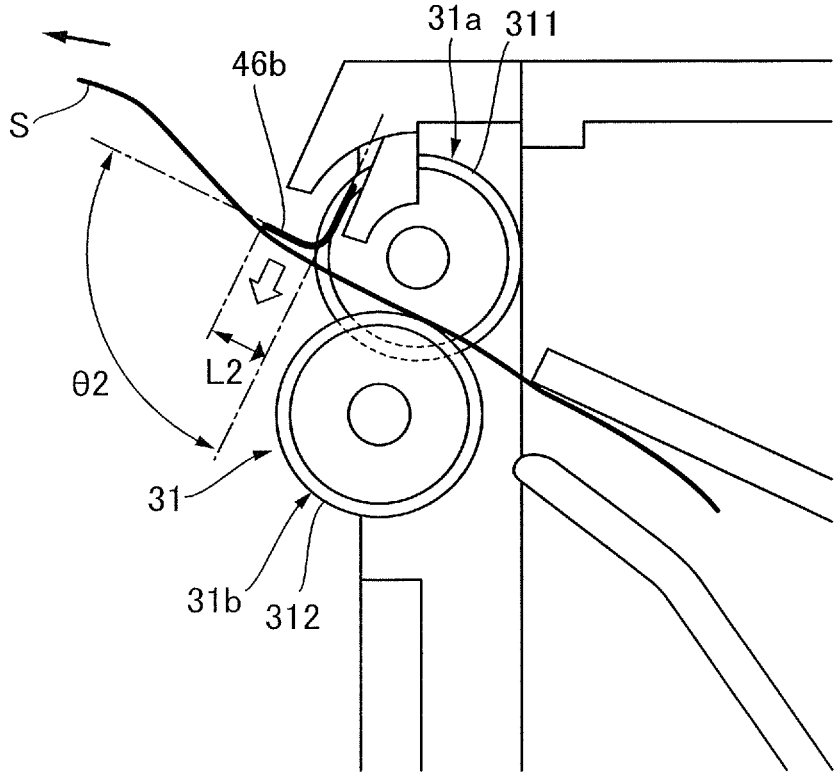
FIG. 9 is a diagram for describing contact between a sheet surface and the upstream brush in the second exemplary embodiment.

In addition, as illustrated in FIG. 9, an angle θ2 by which the upstream brush 46*b* is warped by being pressed by the sheet having high stiffness described with reference to FIG. 5 in the first exemplary embodiment is smaller than θ1 of the first exemplary embodiment in which the entirety of the charge-removing brush is separated from the discharge roller pair 31. That is, θ2<θ1 holds. In addition, since the projection amount of the distal ends of the upstream brush 46*b* with respect to the sheet is set to be smaller than in the first exemplary embodiment, a length L2 of a region where the upstream brush 46*b* rubs the sheet is smaller than L1 of the first exemplary embodiment. That is, L2<L1 holds. Therefore, the risk of the contact with the charge-removing brush 46 leaving a scratch mark on the surface of the sheet can be reduced.

Figure 10B:
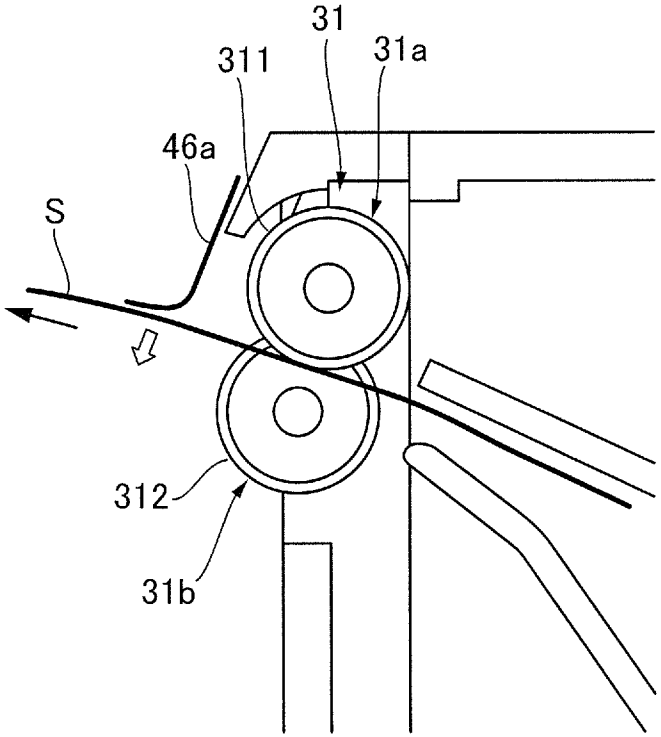
FIG. 10B is another diagram for describing abutment between the sheet and the downstream brush in the second exemplary embodiment.
Figure 10A:
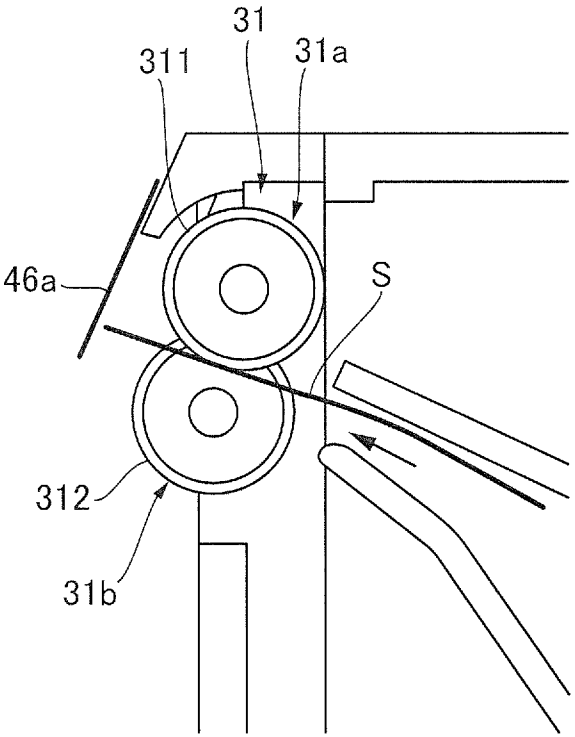
FIG. 10A is a diagram for describing abutment between a sheet and a downstream brush in the second exemplary embodiment.

To be noted, the downstream brush 46*a* preferably extends more downward than the upstream brush 46*b* in the thickness direction D3 as illustrated in FIG. 7 such that the downstream brush 46*a* stably comes into contact with the sheet regardless of the material of the sheet. This is because in a region where the downstream brush 46*a* is provided, the sheet is pushed down by the upper roller 31*a* as illustrated in FIGS. 10A and 10B, and therefore damage to the leading edge of the sheet or the scratch mark on the surface of the sheet is not likely to occur even in the case where the charge-removing brush is long.

The configuration of the present exemplary embodiment described above enables dealing with various sheets and environments while securing charge removing performance of the charge-removing brush 46, and reduces the risk of damage to the sheet.

Third Exemplary Embodiment

In the first and second exemplary embodiments, the discharge roller pair having a comb-teeth shape is used as a means for imparting stiffness to the sheet being discharged. In a third exemplary embodiment, a configuration in which a guide for imparting stiffness is used in addition to a discharge roller pair will be described. Hereinafter, elements having the same configuration and same effect as in the first or second exemplary embodiment will be denoted by the same reference signs as in the first or second exemplary embodiment, and the description thereof will be omitted.

Figure 11A:
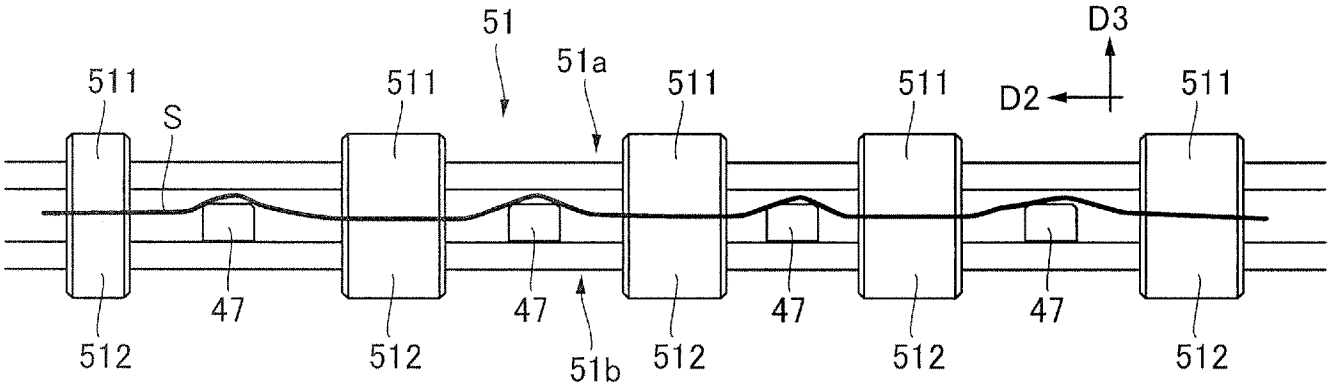
FIG. 11A is a perspective view of a sheet discharge portion of a third exemplary embodiment.

In a sheet discharge portion of the present exemplary embodiment, as illustrated in FIG. 11A, stiffness imparting guides 47 are disposed as stiffness imparting members that impart stiffness to a sheet discharged by a discharge roller pair 51. The discharge roller pair 51 serving as another example of a discharging unit is a roller pair in which rolling members 511 of an upper roller 51*a* serving as first rotary members and rolling members 512 of a lower roller 51*b* serving as second rotary members abut each other. The stiffness imparting guides 47 are disposed at a plurality of positions between adjacent rolling members 511 and 512 in the sheet width direction D2.

Figure 11B:
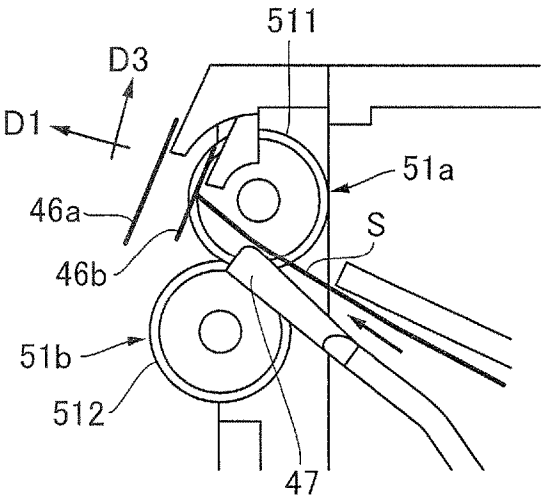
FIG. 11B is a section view of the sheet discharge portion of the third exemplary embodiment.

In addition, as illustrated in FIG. 11B, the stiffness imparting guides 47 are disposed to come into contact with the same sheet surface as the surface that one of the discharge roller pair 51 comes into contact with, and project toward the axial position of the other of the discharge roller pair 51 with respect to a nipping position of the sheet by the discharge roller pair 51 in the thickness direction D3. In the present exemplary embodiment, the stiffness imparting guides 47 are disposed on the same side as the lower roller 51*b* and project to positions that overlap with the rolling members 511 of the upper roller 51*a* as viewed in the sheet width direction D2. Therefore, the sheet S delivered out from the discharge roller pair 51 is pushed up between the rolling members 511 and 512 by the stiffness imparting guides 47, and is warped in a wavy shape as viewed from the downstream side in the sheet discharge direction D1.

Figure 11C:
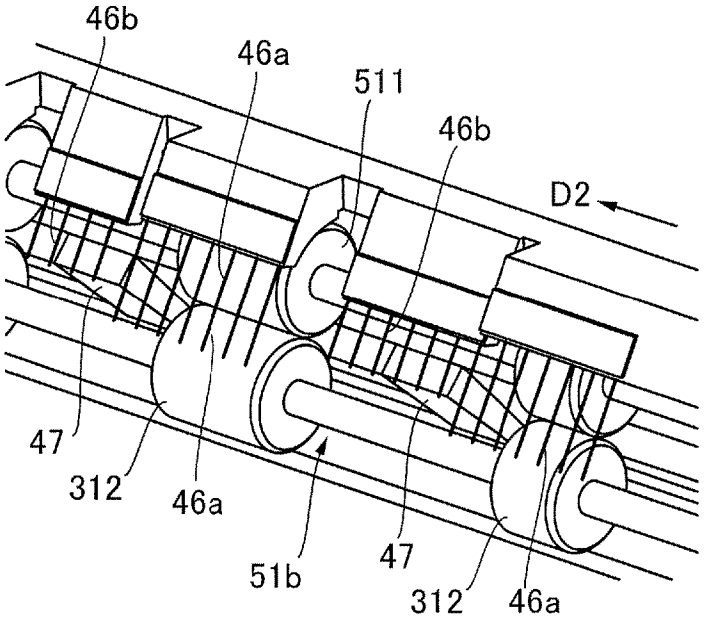
FIG. 11C is an enlarged view of the sheet discharge portion of the third exemplary embodiment.

As illustrated in FIG. 11C, the charge-removing brush 46 positioned on the opposite side to the stiffness imparting guides 47 in the thickness direction D3 can be divided into the downstream brush 46*a* and the upstream brush 46*b*. In the sheet width direction D2, the downstream brush 46*a* is disposed in regions corresponding to the rolling members 511 and 512, and the upstream brush 46*b* is disposed in regions corresponding to the stiffness imparting guides 47, that is, such regions that the upstream brush 46*b* at least partially overlaps with contact portions between the stiffness imparting guides 47 and the sheet. The configuration of the upstream brush 46*b* and the downstream brush 46*a* as viewed in the sheet width direction D2 is the same as in the second exemplary embodiment. That is, the upstream brush 46*b* is disposed upstream of the downstream brush 46*a* in the sheet discharge direction D1 such that the distal ends of the upstream brush 46*b* are offset upward in the thickness direction D3 with respect to the distal ends of the downstream brush 46*a*.

As a result of this, the risk of occurrence of damage to the leading edge of the sheet and the scratch mark on the surface of the sheet caused by contact with the upstream brush 46*b* is reduced in regions in the sheet width direction D2 where the stiffness imparting guides 47 are provided even in the case where a sheet having high stiffness is discharged while being pushed up by the stiffness imparting guides 47. That is, the configuration of the present exemplary embodiment also enables dealing with various sheets and environments while securing charge removing performance of the charge-removing brush 46, and reduces the risk of damage to the sheet.

To be noted, the stiffness imparting guides 47 of the present exemplary embodiment are an example of stiffness imparting members, and for example, stiffness imparting portions having brim-like shapes, or flange-like shapes, having larger outer diameters than the outer peripheral surfaces of the rolling members 511 of the upper roller 51*a* may be provided on both end portions of each of the rolling members 512 of the lower roller 51*b*. In this case, the upstream brush 46*b* may be disposed in regions in the sheet width direction D2 corresponding to the stiffness imparting portions having brim-like shapes, for example, in regions where the sheet is warped upward in convex shapes by the stiffness imparting portions provided on adjacent rolling members.

Figure 12:
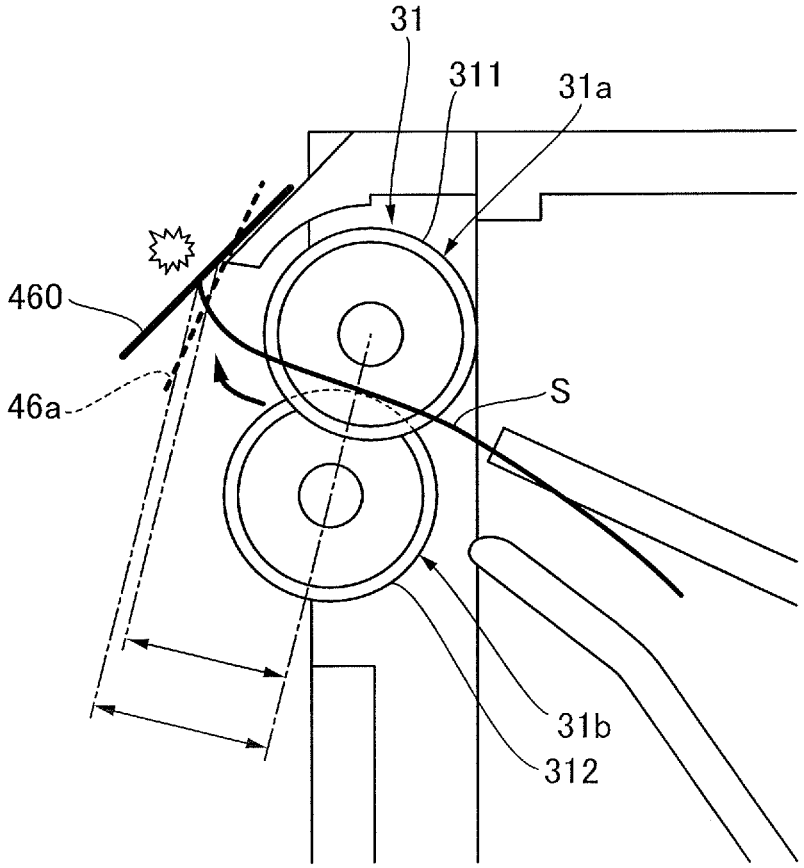
FIG. 12 is a diagram for describing contact between a leading edge of the sheet and a charge-removing brush in a reference embodiment.
Figure 13:
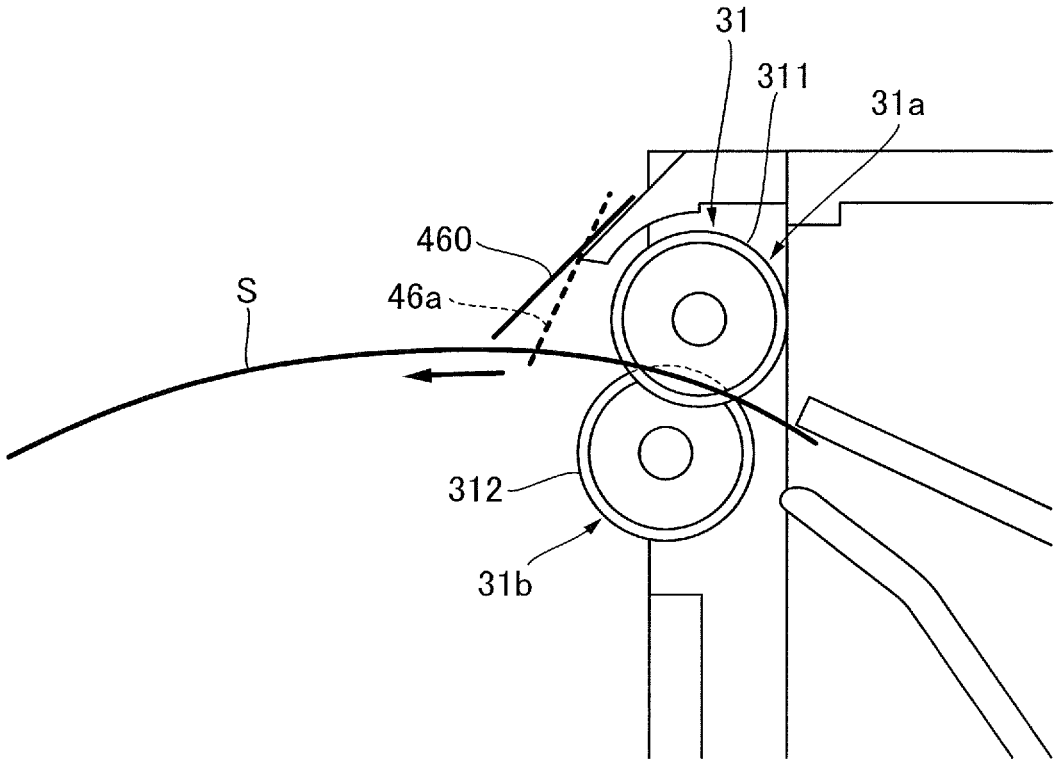
FIG. 13 is a diagram for describing contact between a surface of the sheet and the charge-removing brush in the reference embodiment.

Incidentally, in the second and third exemplary embodiments, the damage to the leading edge of the sheet and the scratch mark on the surface of the sheet caused by contact with the charge-removing brush are reduced by disposing the charge-removing brush at different positions in the sheet discharge direction D1 in accordance with regions in the sheet width direction D2. As another method of reducing the damage to the sheet caused by the contact with the charge-removing brush, disposing a charge-removing brush 460 in a laying angle, that is, reducing the angle formed between a direction in which the brush extends and the sheet discharge direction D1 as illustrated in FIG. 12 can be considered. To be noted, it is assumed that the charge-removing brush 460 of a reference embodiment illustrated in FIGS. 12 and 13 is configured to have the same lengths as and is disposed at the same position in the sheet discharge direction D1 as the downstream brush 46*a* of the first exemplary embodiment in the entire region thereof in the sheet width direction D2. By disposing the charge-removing brush 460 in a laying angle, it can be expected that the collision angle between the leading edge of the sheet and the charge-removing brush 460 and the angle of warpage of the charge-removing brush 460 caused by being pressed by a sheet having high stiffness are suppressed to reduce the damage to the sheet.

However, in this reference embodiment, since the entirety of the brush is separated from the discharge roller pair 31, the charge-removing brush 460 is positioned more on the downstream side in the sheet discharge direction D1 than the upstream brush 46*b* of the first exemplary embodiment indicated by a broken line, in the regions in the sheet width direction D2 corresponding to the rolling members 312 of the lower roller 31*b*. In addition, in the case where the position of the base portion of the charge-removing brush 460 is the same as that of the downstream brush 46*a* of the first exemplary embodiment, the contact position of the charge-removing brush 460 and the sheet is further on the downstream side in the sheet discharge direction D1 than that of the downstream brush 46*a* of the first exemplary embodiment as illustrated in FIG. 13 because the charge-removing brush 460 is disposed in a laying angle.

Therefore, the charge-removing brush 460 comes into contact with the sheet at a position far away from the discharge roller pair 31 in the regions in the sheet width direction D2 where the rolling members 312 of the lower roller 31*b* are provided. Accordingly, even though the charge-removing brush 460 is disposed in a laying angle, there is a case where the damage to the leading edge of the sheet and the scratch mark on the surface of the sheet cannot be effectively reduced as a result of the sheet coming into contact with the charge-removing brush 460 in a state in which the discharge angle of the sheet is deviated upward from the sheet discharge direction D1.

In addition, in the case where the charge-removing brush 460 is disposed in a laying angle, the distal ends of the brush are positioned away from the discharge roller pair 31, and higher than the distal ends of the downstream brush 46*a* of the first exemplary embodiment if the length of the brush is the same. In this case, there is a possibility that the trailing edge side of the sheet does not come into contact with the charge-removing brush 460 when the sheet is likely to warp downward before the trailing edge of the sheet passes through the discharge roller pair 31, for example, when the sheet has low stiffness or the sheet is long, as illustrated in FIG. 13. In the case where the charge-removing brush 460 is made longer to address charge removing failure of this kind, the contact length of the charge-removing brush 460 with a sheet having high stiffness increases, which makes a scratch mark more likely to be formed on the surface of the sheet.

In contrast, according to the configurations of the second and third exemplary embodiments, the upstream brush 46*b* and the downstream brush 46*a* are disposed at different positions in the sheet discharge direction D1, and therefore the risk of damage to the sheet caused by the contact with the charge-removing brush can be reduced while avoiding the inconveniences described above.

Fourth Exemplary Embodiment

Although the entirety of the charge-removing brush is disposed in a laying angle in the reference embodiment described above, disposing part of the charge-removing brush in a laying angle is effective in the configuration in which the position of the charge-removing brush in the sheet discharge direction is changed by the regions in the sheet width direction as described in the second and third exemplary embodiments. An embodiment in which the installation angle of the upstream brush 46*b* of the second exemplary embodiment is changed will be described as a fourth exemplary embodiment. Hereinafter, elements having the same configurations and effects as in the second exemplary embodiment will be denoted by the same reference signs as in the second exemplary embodiment, and description thereof will be omitted.

Figure 14A:
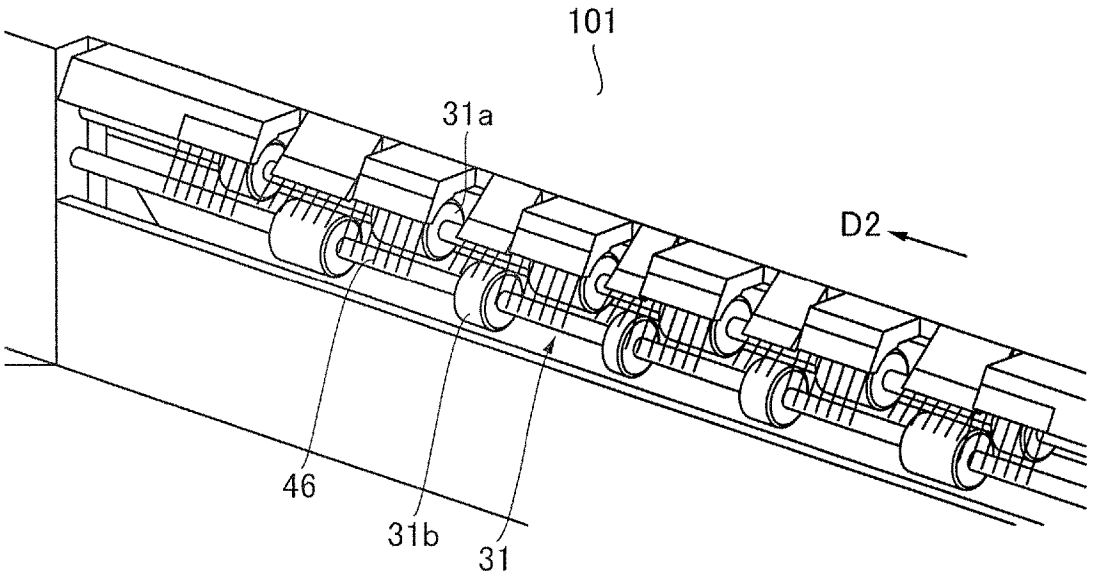
FIG. 14A is a perspective view of a sheet discharge portion of a fourth exemplary embodiment.
Figure 14C:
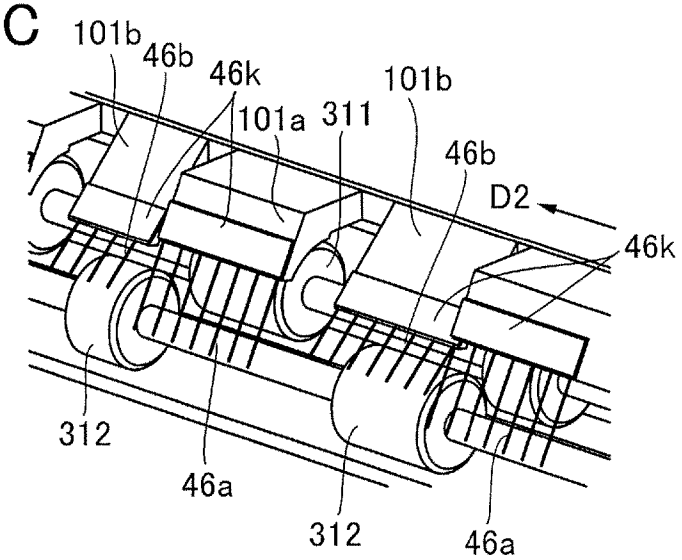
FIG. 14C is an enlarged view of the sheet discharge portion of the fourth exemplary embodiment.

As illustrated in FIG. 14A, the discharge roller pair 31 has an arrangement of a comb-teeth shape similarly to the second exemplary embodiment, and imparts stiffness to the nipped sheet by warping the nipped sheet. In addition, as illustrated in FIG. 14C, the charge-removing brush 46 is also provided in different positions in the sheet discharge direction D1 depending on the regions in the sheet width direction D2 similarly to the second exemplary embodiment. That is, the upstream brush 46*b* provided in the regions corresponding to the rolling members 312 of the lower roller 31*b* is positioned upstream of the downstream brush 46*a* provided in the regions corresponding to the rolling members 311 of the upper roller 31*a* in the sheet discharge direction D1. Therefore, in a state in which the charge-removing brush 46 is not in contact with the sheet, the length Z1 of the line segment drawn from the nip position of the discharge roller pair 31 to the downstream brush 46*a* in the sheet discharge direction D1 is larger than the length Z2 of the line segment drawn from the nip position to the upstream brush 46*b*. Further, as illustrated in FIGS. 14B and 14C, the attachment surface 101*b* of the printer body 101 serving as a first attachment surface to which the base portion 46*k* of the upstream brush 46*b* is attached is positioned upstream of the attachment surface 101*a* of the printer body 101 serving as a second attachment surface to which the base portion 46*k* of the downstream brush 46*a* is attached, in the sheet discharge direction D1.

Figure 14B:
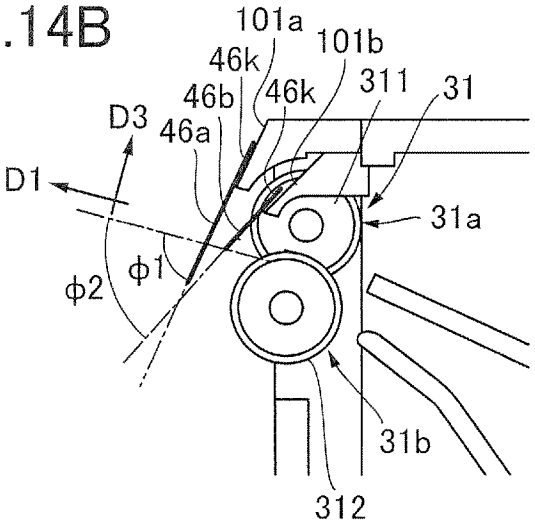
FIG. 14B is a section view of the sheet discharge portion of the fourth exemplary embodiment.

Here, the upstream brush 46*b* of the present exemplary embodiment is disposed in such an angle that the upstream brush 46*b* is laid flatter than the downstream brush 46*a* such that the contact angle of the upstream brush 46*b* with the sheet is smaller than that of the downstream brush 46*a* as illustrated in FIG. 14B. In other words, an angle φ2 formed between the direction in which the upstream brush 46*b* extends and the sheet discharge direction D1 is smaller than an angle φ1 formed between the direction in which the downstream brush 46*a* extends and the sheet discharge direction D1. To be noted, the directions in which the upstream brush 46*b* and the downstream brush 46*a* extend are directions from the base portion 46*k* of the brush toward the distal ends of the brush in a state in which the sheet is not in contact with the brush. The installation angles described above can be realized by, for example, a configuration in which the attachment surface 101*b* of the base portion 46*k* of the upstream brush 46*b* serving as a first attachment surface has an angle different from the angle of the attachment surface 101*a* of the base portion 46*k* of the downstream brush 46*a* serving as a second attachment surface, and the angle formed between the direction in which the attachment surface 101*a* extends and the sheet discharge direction D1, that is, φ1, is smaller than the angle formed between the direction in which the attachment surface 101*b* extends and the sheet discharge direction D1, that is, φ2.

According to such a configuration, the portion of the sheet discharged while pushed up by the rolling members 312 of the lower roller 31*b* comes into contact with the upstream brush 46*b* at a position close to the discharge roller pair 31. Therefore, similarly to the second exemplary embodiment, the risk of damage to the leading edge of the sheet and the scratch mark on the surface of the sheet caused by the contact with the charge-removing brush 46 can be reduced.

Figure 15:
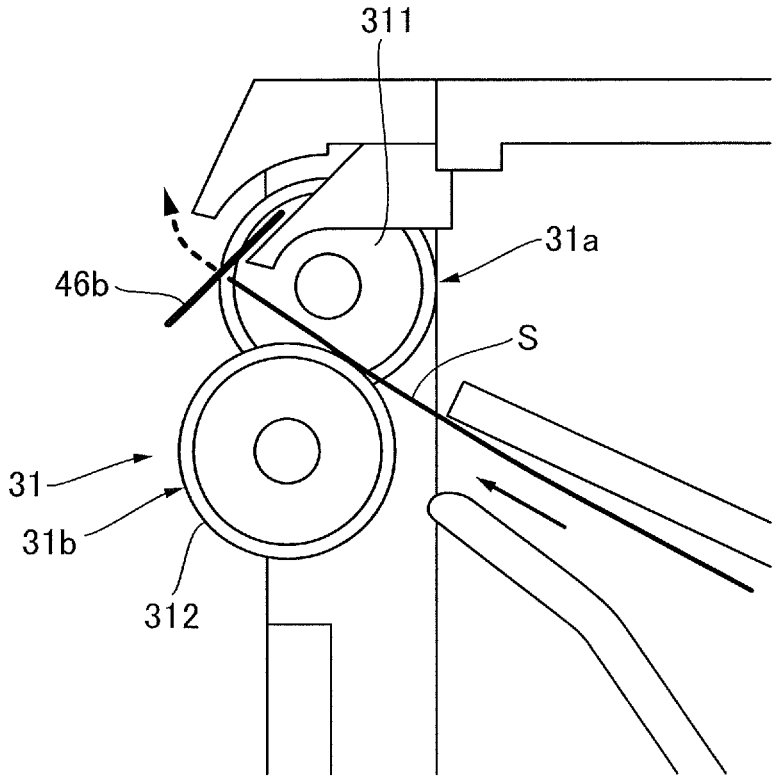
FIG. 15 is a diagram for describing contact between a leading edge of the sheet and an upstream brush in the fourth exemplary embodiment.
Figure 16:
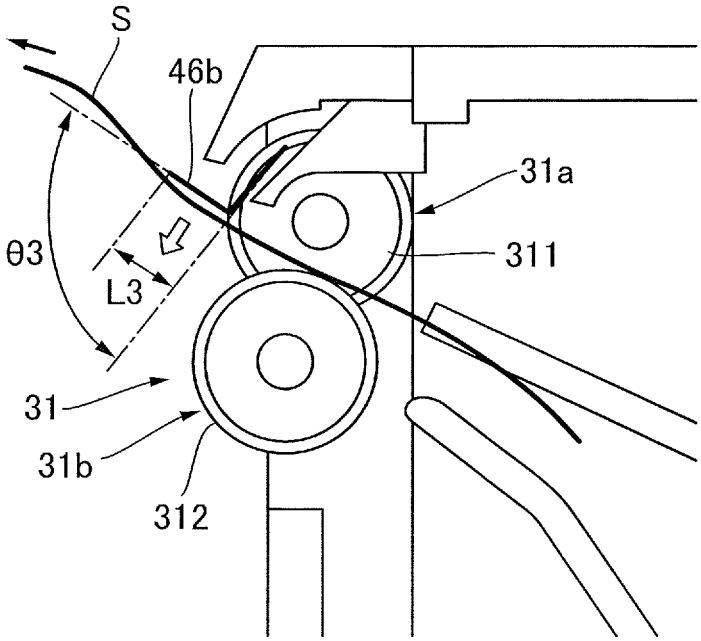
FIG. 16 is a diagram for describing contact between a surface of the sheet and the upstream brush in the fourth exemplary embodiment.

In addition, since the upstream brush 46*b* is disposed in a laying angle in the present exemplary embodiment, the collision angle of the upstream brush 46*b* and the leading edge of the sheet can be reduced as compared with the second exemplary embodiment as illustrated in FIG. 15, and therefore the damage to the leading edge of the sheet can be further reduced. Further, as illustrated in FIG. 16, an angle θ3 by which the upstream brush 46*b* is warped by the sheet having high stiffness and a length L3 of the region where the upstream brush 46*b* rubs the surface of the sheet can be also reduced as compared with θ2 and L2 of the second exemplary embodiment, and thus the scratch mark on the surface of the sheet can be further reduced. In contrast, by setting the installation angle of the downstream brush 46*a* such that the downstream brush 46*a* stands more upright than the upstream brush 46*b*, the possibility of occurrence of charge removing failure for a sheet likely to warp downward while being discharged such as a sheet having low stiffness or a long sheet can be reduced.

The configuration of the present exemplary embodiment described above enables dealing with various sheets and environments while securing charge removing performance of the charge-removing brush 46, and further reduces the risk of damage to the sheet. To be noted, the same effect of further reducing the damage to the sheet can be also obtained by applying the configuration of the upstream brush 46*b* described in the present exemplary embodiment to the third exemplary embodiment.

Fifth Exemplary Embodiment

In the second to fourth exemplary embodiments, examples in which the position of the charge-removing brush in the sheet discharge direction is changed in accordance with regions in the width direction in the configuration in which the sheet is discharged in a state of being warped by the discharge roller pair 31 of a comb-teeth shape or the stiffness imparting members have been described. The configuration is not limited to such a configuration in which the position of the charge-removing brush is changed in accordance with the regions in the sheet width direction corresponding to the wavy shape of the sheet, and, in the case where a region where damage to the sheet is likely to occur is known in advance, the charge-removing brush in that region may be disposed on the upstream side in the sheet discharge direction. Hereinafter, a configuration in which the charge-removing brush is disposed on the upstream side in the sheet discharge direction in end regions in the sheet width direction will be described as a fifth exemplary embodiment.

Figure 17A:
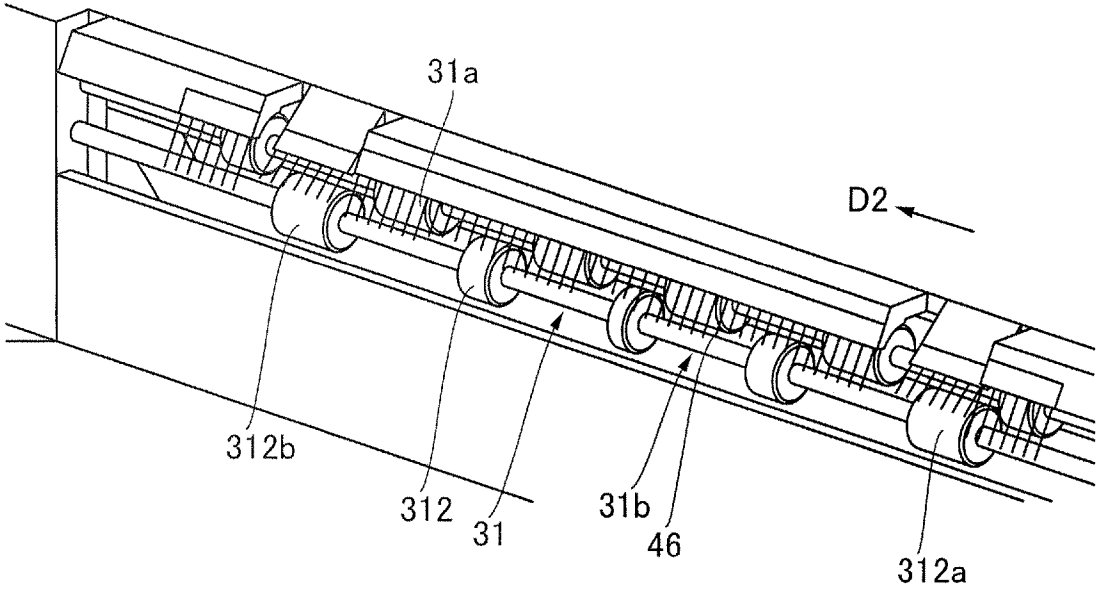
FIG. 17A is a perspective view of a sheet discharge portion of a fifth exemplary embodiment.

As illustrated in FIG. 17A, the discharge roller pair 31 of the present exemplary embodiment has a comb-teeth shape, and the upper roller 31*a* and the lower roller 31*b* respectively include a plurality of rolling members 311 and a plurality of rolling members 312. Among the rolling members 312 included in the lower roller 31*b*, rolling members 312*a* and 312*b* positioned at two ends in the sheet width direction D2 are at end positions of a wider sheet among sheets supported by the image forming apparatus 100, for example, an A4 sheet conveyed in an orientation in which a longer side thereof is in the sheet width direction D2.

Therefore, when such a wide sheet is discharged, there is a risk that side edges of the sheet strongly come into contact with the charge-removing brush as a result of being delivered out while being pushed up by the rolling members 312*a* and 312*b*, and the damage to the leading edge of the sheet and the scratch mark on the surface of the sheet occur in the vicinity of the side edges of the sheet. In contrast, in regions in the sheet width direction D2 corresponding to the other rolling members 312 of the lower roller 31*b*, the discharge angle is restricted by adjacent rolling members 311 of the upper roller 31*a*, and therefore the possibility of occurrence of damage to the sheet is lower than in the vicinity of the side edges. In addition, the possibility of occurrence of damage to the sheet is also low in side edge portions of a narrow sheet whose side edge portions do not come into contact with the rolling members 312*a* and 312*b*.

Therefore, in the charge-removing brush 46 of the present exemplary embodiment, an upstream brush 46*f* is provided in regions in the sheet width direction D2 corresponding to the rolling members 312*a* and 312*b* positioned at end portions of the lower roller 31*b*, and a downstream brush 46*e* is provided in regions corresponding to the other rolling members. The upstream brush 46*f* serves as a first charge-removing portion, that is, a first portion of a charge-removing member in the present exemplary embodiment, and the downstream brush 46*e* serves as a second charge-removing portion, that is, a second portion of the charge-removing member in the present exemplary embodiment.

Figure 17C:
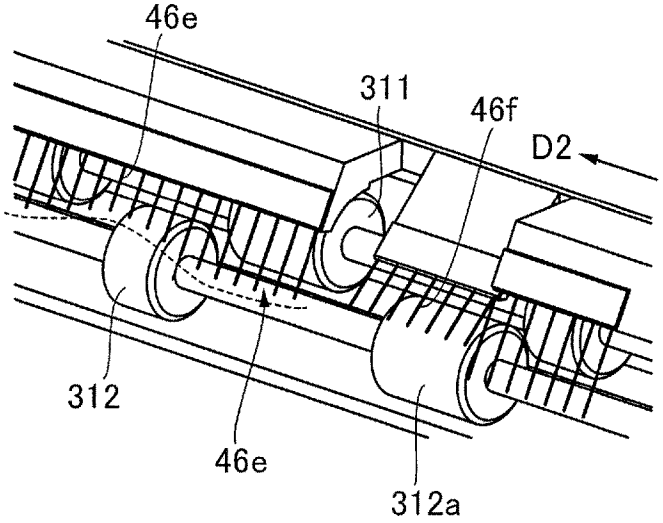
FIG. 17C is an enlarged view of the sheet discharge portion of the fifth exemplary embodiment.
Figure 17B:
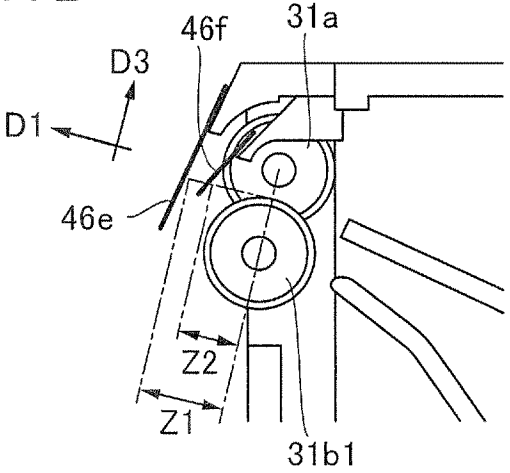
FIG. 17B is a section view of the sheet discharge portion of the fifth exemplary embodiment.

As illustrated in FIG. 17B, the upstream brush 46*f* is positioned upstream of the downstream brush 46*e* in the sheet discharge direction D1. Therefore, in a state in which the charge-removing brush 46 is not in contact with the sheet, the length Z1 of the line segment drawn from the nip position of the discharge roller pair 31 to the downstream brush 46*e* in the sheet discharge direction D1 is larger than the length Z2 of the line segment drawn from the nip position to the upstream brush 46*f*. Further, it is preferable that the upstream brush 46*f* is disposed in such an angle that the upstream brush 46*f* is laid flatter than the downstream brush 46*e* similarly to the fourth exemplary embodiment.

As described above, by providing the upstream brush 46*f* in regions in the sheet width direction D2 where a wide sheet is likely to be damaged, the possibility of occurrence of damage to the sheet can be reduced similarly to the first to fourth exemplary embodiments.

Meanwhile, as illustrated in FIG. 17C, the downstream brush 46*e* is provided in a region including at least one of the rolling members 312 in the sheet width direction D2. The downstream brush 46*e* positioned between the two portions of the upstream brush 46*f* is advantageous in terms of ease of assembly and reduction of cost in the case where, for example, the downstream brush 46*e* is formed as one member having a connected base portion. In addition, the length of the downstream brush 46*e* is preferably changed in accordance with the position in the sheet width direction D2 along the wavy shape of the sheet formed by the discharge roller pair 31 similarly to the first exemplary embodiment. That is, the length of the downstream brush 46*e* in the regions corresponding to the rolling members 312 of the lower roller 31*b* is set to be smaller than the length of the downstream brush 46*e* in the regions corresponding to the rolling members 311 of the upper roller 31*a*. As a result of this, the downstream brush 46*e* can be brought into contact with the sheet at a uniform contact pressure in a stable contact state such that high charge removing performance can be exhibited.

Sixth Exemplary Embodiment

Incidentally, the sheet discharged by the sheet discharging apparatus is sometimes curled due to the nature of the sheet itself, change in the amount of moisture caused by image formation, or the like. Therefore, a configuration capable of reducing damage to the sheet caused by contact of the charge-removing brush with a curled sheet will be described as a sixth exemplary embodiment.

Figure 18A:
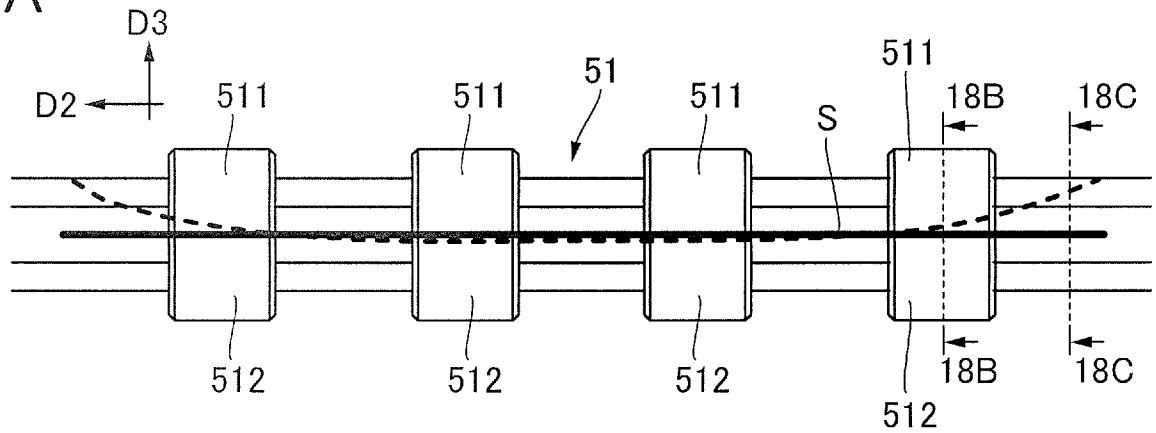
FIG. 18A is a perspective view of a sheet discharge portion of a sixth exemplary embodiment.
Figure 18C:
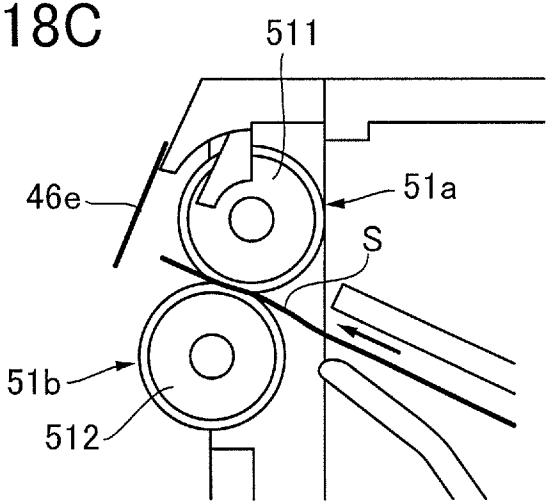
FIG. 18C is an enlarged view of the sheet discharge portion of the sixth exemplary embodiment.

As illustrated in FIG. 18A, the discharge roller pair 51 of the present exemplary embodiment does not have a comb-teeth shape, and similarly to the third exemplary embodiment, the rolling members 511 of the upper roller 51*a* and the rolling members 512 of the lower roller 51*b* abut each other. Further, side edge portions of a sheet S of a size illustrated in FIG. 18A is out of a range where the upper roller 51*a* and the lower roller 51*b* are capable of nipping the sheet S.

In such a configuration, as the sheet S delivered out from the discharge roller pair 51 moves more downstream and away from the discharge roller pair 51 in the sheet discharge direction D1, the sheet is sometimes more likely to be curled to be warped into a U shape as viewed from the downstream side in the sheet discharge direction D1. This is indicated by a broken line in FIG. 18A. In this case, if the charge-removing brush is provided at a position downstream of and away from the discharge roller pair 51 in the sheet discharge direction D1, there is a risk that the sheet strongly comes into contact with the charge-removing brush in a state in which the discharge angle of the side edge portions of the sheet is deviated upward from the sheet discharge direction D1 and thus the sheet is damaged.

Figure 18B:
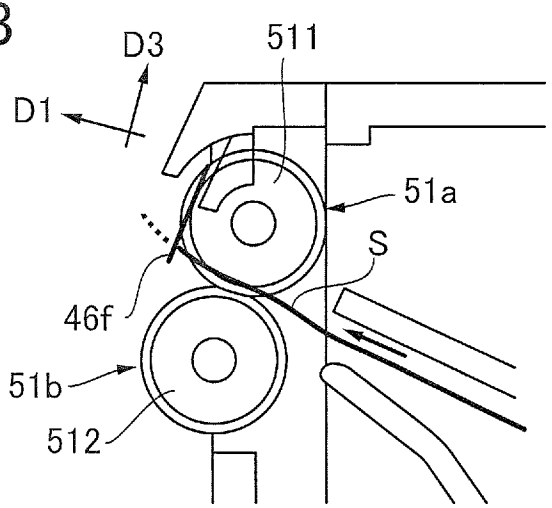
FIG. 18B is a section view of the sheet discharge portion of the sixth exemplary embodiment.

Therefore, in the present exemplary embodiment, as illustrated in FIG. 18B, the upstream brush 46*f* is disposed on both outer sides of a region in the sheet width direction D2 where the rolling members 511 and 512 are provided, that is, a region from the rolling members 511 and 512 at the right end to the rolling members 511 and 512 at the left end in FIG. 18A. Meanwhile, the downstream brush 46*e* is disposed inside the region where the rolling members 511 and 512 are provided as illustrated in FIG. 18B. The upstream brush 46*f* is provided upstream of the downstream brush 46*e* in the sheet discharge direction D1, and partially overlaps with the rolling members 511 of the upper roller 31*a* as viewed in the sheet width direction D2.

According to the configuration of the present exemplary embodiment, even in the case where the sheet delivered out from the discharge roller pair 51 gradually starts to curl, the upstream brush 46*f* comes into contact with the sheet at a position near the discharge roller pair 51. As a result of this, strong contact of the side edge portions of the sheet with the charge-removing brush can be prevented, and the possibility of occurrence of damage to the leading edge of the sheet and scratch mark on the surface of the sheet can be reduced.

OTHER EMBODIMENTS

Although a sheet discharging apparatus that discharges a sheet on which an image has been formed from a printer body has been described in the exemplary embodiments described above, the present technique can be also applied to other sheet discharging apparatuses. Examples of such sheet discharging apparatuses include an apparatus for discharging a sheet processed by a sheet processing apparatus, and an apparatus that discharges a document sheet whose image information has been read by an image reading apparatus.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-246304, filed on Dec. 27, 2018, which is hereby incorporated by reference herein in its entirety.

What is claimed is:

1. A sheet discharging apparatus comprising:

a discharging unit configured to discharge a sheet in a sheet discharge direction, comprising a first roller and a second roller, and configured such that the sheet nipped between the first roller and the second roller is warped as viewed from a downstream side in the sheet discharge direction, the first roller comprising a plurality of first rotary members configured to come into contact with a first surface of the sheet, the second roller comprising a plurality of second rotary members configured to come into contact with a second surface of the sheet;

a sheet supporting member configured to support the sheet discharged by the discharging unit;

a first charge-removing portion configured to remove electrostatic charges of the sheet by coming into contact with the sheet at a position downstream of a position where the first roller and the second roller nip the sheet in the sheet discharge direction; and a second charge-removing portion configured to remove electrostatic charges of the sheet by coming into contact with the sheet at a position downstream of the position where the first charge-removing portion comes into contact with the sheet in the sheet discharge direction, wherein the plurality of first rotary members and the plurality of second rotary members are disposed at positions different from each other in a sheet width direction perpendicular to the sheet discharge direction so as to partially overlap with each other as viewed in the sheet width direction, wherein the first charge-removing portion and the second charge-removing portion are disposed to be located on the same side as the first roller with respect to the sheet discharged by the discharging unit, and wherein, in the sheet width direction, at least part of the first charge-removing portion is provided in a region corresponding to one of the plurality of second rotary members, and at least part of the second charge-removing portion is provided in a region corresponding to one of the plurality of first rotary members.

2. The sheet discharging apparatus according to claim 1, wherein the first charge-removing portion comprises a plurality of portions respectively disposed in a plurality of first regions separated from each other in the sheet width direction, wherein the second charge-removing portion comprises a plurality of portions respectively disposed in a plurality of second regions separated from each other in the sheet width direction, and wherein the plurality of first regions and the plurality of second regions are alternately arranged in the sheet width direction.

3. The sheet discharging apparatus according to claim 1, wherein, in the sheet width direction, the first charge-removing portion comprises a plurality of portions respectively provided in a plurality of regions corresponding to the plurality of second rotary members, and the second charge-removing portion comprises a plurality of portions respectively provided in a plurality of regions corresponding to the plurality of first rotary members.

4. The sheet discharging apparatus according to claim 1, wherein, in the sheet width direction, the first charge-removing portion is provided in two regions corresponding to two of the plurality of second rotary members positioned at two ends in the sheet width direction, and the second charge-removing portion is provided in a region positioned between the two regions and comprising at least one of the plurality of second rotary members.

5. A sheet discharging apparatus comprising:

a discharging unit configured to discharge a sheet in a sheet discharge direction, comprising a first roller and a second roller, and configured such that the sheet nipped between the first roller and the second roller is warped as viewed from a downstream side in the sheet discharge direction, the first roller comprising a plurality of first rotary members configured to come into contact with a first surface of the sheet, the second roller comprising a plurality of second rotary members configured to come into contact with a second surface of the sheet;

a sheet supporting member configured to support the sheet discharged by the discharging unit;

a first charge-removing portion configured to remove electrostatic charges of the sheet by coming into contact with the sheet at a position downstream of a position where the first roller and the second roller nip the sheet in the sheet discharge direction; and a second charge-removing portion configured to remove electrostatic charges of the sheet by coming into contact with the sheet at a position downstream of the position where the first charge-removing portion comes into contact with the sheet in the sheet discharge direction, wherein the discharging unit further comprises a stiffness imparting member configured to warp the sheet as viewed in the sheet discharge direction by coming into contact with the sheet at a position different from positions where the plurality of first rotary members and the plurality of second rotary members come into contact with the sheet in a sheet width direction perpendicular to the sheet discharge direction, wherein the first charge-removing portion and the second charge-removing portion are disposed on an opposite side to the stiffness imparting member with respect to the sheet discharged by the discharging unit, and wherein, in the sheet width direction, the first charge-removing portion is provided at a position corresponding to the stiffness imparting member, and the second charge-removing portion is provided at a position separated from the stiffness imparting member.

6. The sheet discharging apparatus according to claim 1, wherein, as viewed in the sheet width direction, the first charge-removing portion intersects with at least one of an outer peripheral surface of the first roller and an outer peripheral surface of the second roller, and the second charge-removing portion is provided downstream of and away from both of the first roller and the second roller in the sheet discharge direction.

7. The sheet discharging apparatus according to claim 1, wherein the first charge-removing portion and the second charge-removing portion are disposed to abut the same surface of the sheet discharged by the discharging unit, and wherein, in a thickness direction of the sheet discharged by the discharging unit, a position of a distal end of the first charge-removing portion is offset in such a direction that a projection amount of the first charge-removing portion with respect to the sheet is smaller than a projection amount of the second charge-removing portion with respect to the sheet.

8. A sheet discharging apparatus comprising:

a discharging unit configured to discharge a sheet in a sheet discharge direction, comprising a first roller and a second roller, and configured such that the sheet nipped between the first roller and the second roller is warped as viewed from a downstream side in the sheet discharge direction, the first roller comprising a plurality of first rotary members configured to come into contact with a first surface of the sheet, the second roller comprising a plurality of second rotary members configured to come into contact with a second surface of the sheet;

a sheet supporting member configured to support the sheet discharged by the discharging unit;

a first charge-removing portion configured to remove electrostatic charges of the sheet by coming into contact with the sheet at a position downstream of a position where the first roller and the second roller nip the sheet in the sheet discharge direction; and a second charge-removing portion configured to remove electrostatic charges of the sheet by coming into contact with the sheet at a position downstream of the position where the first charge-removing portion comes into contact with the sheet in the sheet discharge direction, wherein, as viewed in a sheet width direction perpendicular to the sheet discharge direction, the first charge-removing portion and the second charge-removing portion extend in directions that intersect with the sheet discharge direction, and an angle formed between a direction in which the first charge-removing portion extends and the sheet discharge direction is smaller than an angle formed between a direction in which the second charge-removing portion extends and the sheet discharge direction.

9. The sheet discharging apparatus according to claim 1, wherein the first charge-removing portion and the second charge-removing portion are each a brush-shaped member comprising a base portion and fiber and formed from a flexible material having electrical conductivity, the base portion being attached to an attachment portion provided in a body of the sheet discharging apparatus, the fiber being configured to come into contact with the sheet discharged by the discharging unit.

10. The sheet discharging apparatus according to claim 9, wherein the attachment portion comprises a first attachment surface to which the base portion of the first charge-removing portion is attached and a second attachment surface to which the base portion of the second charge-removing portion is attached, and the first attachment surface is positioned upstream of the second attachment surface in the sheet discharge direction.

11. The sheet discharging apparatus according to claim 10, wherein, as viewed in the sheet width direction, an angle of the first attachment surface is different from an angle of the second attachment surface such that an angle formed between a direction in which the first attachment surface extends and the sheet discharge direction is smaller than an angle formed between a direction in which the second attachment surface extends and the sheet discharge direction.

12. An image forming apparatus comprising:

an image forming portion configured to form an image on a sheet; and the sheet discharging apparatus according to claim 1 configured to discharge the sheet on which an image has been formed by the image forming portion.

13. The sheet discharging apparatus according to claim 5, wherein, as viewed in the sheet width direction, the first charge-removing portion intersects with at least one of an outer peripheral surface of the first roller and an outer peripheral surface of the second roller, and the second charge-removing portion is provided downstream of and away from both of the first roller and the second roller in the sheet discharge direction.

14. The sheet discharging apparatus according to claim 5, wherein the first charge-removing portion and the second charge-removing portion are disposed to abut the same surface of the sheet discharged by the discharging unit, and wherein, in a thickness direction of the sheet discharged by the discharging unit, a position of a distal end of the first charge-removing portion is offset in such a direction that a projection amount of the first charge-removing portion with respect to the sheet is smaller than a projection amount of the second charge-removing portion with respect to the sheet.

15. An image forming apparatus comprising:

an image forming portion configured to form an image on a sheet; and the sheet discharging apparatus according to claim 5 configured to discharge the sheet on which an image has been formed by the image forming portion.

16. The sheet discharging apparatus according to claim 8, wherein, as viewed in the sheet width direction, the first charge-removing portion intersects with at least one of an outer peripheral surface of the first roller and an outer peripheral surface of the second roller, and the second charge-removing portion is provided downstream of and away from both of the first roller and the second roller in the sheet discharge direction.

17. The sheet discharging apparatus according to claim 8, wherein the first charge-removing portion and the second charge-removing portion are disposed to abut the same surface of the sheet discharged by the discharging unit, and wherein, in a thickness direction of the sheet discharged by the discharging unit, a position of a distal end of the first charge-removing portion is offset in such a direction that a projection amount of the first charge-removing portion with respect to the sheet is smaller than a projection amount of the second charge-removing portion with respect to the sheet.

18. An image forming apparatus comprising:

an image forming portion configured to form an image on a sheet; and the sheet discharging apparatus according to claim 8 configured to discharge the sheet on which an image has been formed by the image forming portion.

* * * * *